US006281424B1

(12) United States Patent
Koike et al.

(10) Patent No.: US 6,281,424 B1
(45) Date of Patent: Aug. 28, 2001

(54) INFORMATION PROCESSING APPARATUS AND METHOD FOR REPRODUCING AN OUTPUT AUDIO SIGNAL FROM MIDI MUSIC PLAYING INFORMATION AND AUDIO INFORMATION

(75) Inventors: Takashi Koike, Kanagawa; Kenichi Imai, Tokyo; Minoru Tsuji, Chiba, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/454,845

(22) Filed: Dec. 7, 1999

(30) Foreign Application Priority Data

Dec. 15, 1998 (JP) ..... 10-355973

(51) Int. Cl.[7] ..... G10H 1/42; G10H 7/00
(52) U.S. Cl. ..... 84/636; 84/645; 84/668
(58) Field of Search ..... 84/609–614, 634–638, 84/645, 649–652, 666–669

(56) References Cited

U.S. PATENT DOCUMENTS 5,054,360 * 10/1991 Lisle et al. ..... 84/645
5,300,725 * 4/1994 Manabe ..... 84/645 X
5,648,628 * 7/1997 Ng et al. ..... 84/645 X

* cited by examiner

*Primary Examiner*—Stanley J. Witkowski
(74) *Attorney, Agent, or Firm*—Sonnenschein, Nath & Rosenthal

(57) ABSTRACT

The MIDI reproducing block has such a sound source as a synthesizer and synthesizes and reproduces electronic sounds sequentially according to entered MIDI playing information, thereby generating MIDI sound signals of an accompaniment music. Generated MIDI sound signals are supplied to the mixer. The audio reproducing block reproduces audio sound signals according to entered audio information. Generated audio sound signals are supplied to the mixer. The tempo change time setting block sets a tempo change time in entered tempo change information. Tempo change information in which a tempo change time is set is supplied to both MIDI reproducing block and audio reproducing block. The mixer mixes supplied MIDI sound signals with audio sound signals, thereby generating reproduction signals, then outputs the signals after the sound volume is adjusted. Generated reproduction signals are then supplied to the speaker. The speaker then outputs supplied reproduction signals as sounds. Thus, MIDI sound signals are synchronized with audio sound signals accurately such way when in reproducing.

6 Claims, 20 Drawing Sheets

INFORMATION PROCESSING APPARATUS AND METHOD FOR REPRODUCING AN OUTPUT AUDIO SIGNAL FROM MIDI MUSIC PLAYING INFORMATION AND AUDIO INFORMATION

BACKGROUND OF THE INVENTION

1. Field of the Invention

The present invention relates to an information processing apparatus, an information processing method, and a supply medium, more particularly to an information processing apparatus and an information processing method, which can change the tempo of audio information synchronously with changes of tempo (speed of a tune) for an instrumental accompaniment composed of MIDI (Musical Instruments Digital Interface) information, as well as a supply medium.

2. Background of the Invention

The official gazette of Japanese Patent Laid-Open No.8-234791 has disclosed a musical reproducing apparatus, which can change the tempo of a chorus synchronously with changes of the tempo for an instrumental accompaniment composed of MIDI information without any change of pitches (frequencies). Hereunder, this apparatus will be described with reference to FIG. 20.

The user enters the tempo of a tune from a tempo input block 101. The tempo input block 101 then supplies a tempo change signal corresponding to the entered tempo to the MIDI reproducing block 101 and the chorus reproducing block 103.

The MIDI reproducing block 102 is composed of an accompaniment reproducing block 111 and the accompaniment reproducing block 111 reproduces supplied accompaniment music information (MIDI information), thereby generating accompaniment music signals. The generated accompaniment music signals are supplied to a mixer 104.

The chorus reproducing block 103 is composed of an expanding block 121, a periodicity analyzer 122, a unit periodic data memory 123, and a chorus expanding/thinning-out block 124.

The expanding block 121 expands chorus information compressed with the use of, for example, such a data compression method as MPEG (Moving Picture Experts Group) to audio signals encoded with the PCM (Pulse Code Modulation) method. Decoded chorus information is then supplied to both periodicity analyzer 122 and chorus expanding/thinning-out block 124.

The periodicity analyzer 122 recognizes strong periodicity in the supplied chorus information and extracts one strong period therefrom. The extracted unit periodic data is supplied to the unit periodic data memory 123 and stored there. The stored unit periodic data is read and supplied to the chorus expanding/thinning-out block 124 as needed.

The chorus expanding/thinning-out block 124 generates reproduction chorus signals from chorus information according to the tempo change signal and the unit periodic data supplied respectively. For example, when no tempo is changed, the chorus expanding/thinning-out block 124 outputs supplied chorus information as audio signals without adding any data to nor thinning out any part from the supplied information. If the tempo change signal specifies acceleration of the tempo, however, the chorus expanding/thinning-out block 124 thins out the number of unit periodic data items corresponding to the specified acceleration from the strong periodicity part of the information so as to speed up the tempo. On the contrary, if the tempo change signal specifies slow-down of the tempo, the chorus expanding/thinning-out block 124 adds the number of unit periodic data items corresponding to the specified slowdown to the strong periodicity part of the information so as to slow down the tempo. The tempo of the chorus can thus be changed following up with the change of the accompaniment music without changing pitches of the chorus.

The mixer 104 mixes supplied accompaniment music signals with chorus signals. The mixed signals are then supplied to the amplifier 105. The amplifier 105 mixes the supplied signals with singing voices entered via a microphone 107, then outputs the mixed signals as sounds from a speaker.

In such an information reproducing apparatus as described above, however, characteristics of chorus signals are used to change a tempo. This is why the apparatus, which has not coped with other signals, has been not applied to those signals.

Furthermore, the above apparatus has also been confronted with a problem that a delay time from an accompaniment music is generated if a long time is taken for decoding chorus information, as well as for changing a tempo.

SUMMARY OF THE INVENTION

Under such circumstances, it is an object of the present invention to provide a general-purpose information processing apparatus, which can cope with changes of the tempo of audio information synchronously with changes of the tempo of an accompaniment music composed of MIDI information, as well as a method of compensating for such a delay time to be generated when in reproducing audio information.

As described above, according to the information processing apparatus in accordance with claim 1, the information processing method in accordance with claim 3, and the supply medium in accordance with claim 4, because a delay time generated until entered change information of a musical element is reflected in a MIDI audio signal and the audio signal is compensated, the MIDI audio signal and the audio signal can be synchronized with each other accurately.

The information processing apparatus in accordance with claim 1, which is used for reproducing both MIDI playing information and audio information, comprises MIDI reproducing means for reproducing MIDI music playing information; audio reproducing means for reproducing audio information synchronously with a sync signal generated by the MIDI reproducing means; input means for inputting change information of a musical element when in reproducing; compensating means for compensating for a delay time taken until change information entered to the input means is reflected in a MIDI audio signal output from the MIDI reproducing means, as well as a delay time taken until the change information is reflected in an audio signal output from the audio reproducing means; and mixing means for mixing the MIDI audio signal with the audio signal.

The information processing method in accordance with claim 3, which is used for the above information processing apparatus for reproducing both MIDI playing information and audio information, includes a MIDI reproducing step for reproducing MIDI playing information; an audio reproducing step for reproducing audio information synchronously with a sync signal generated in the MIDI reproducing step; an input step for inputting change information of a musical element when in reproducing; a compensating step for compensating for a delay time taken until change information entered in the input step is reflected in a MIDI audio signal output from the MIDI reproducing means, as well as a delay time taken until the change information is reflected in an audio signal output in the audio reproducing step; and a mixing step for mixing the MIDI audio signal with the audio signal.

The supply medium in accordance with claim 4, which supplies a program readable by a computer that instructs the above information processing apparatus to execute processes in a MIDI reproducing step for reproducing MIDI playing information; an audio reproducing step for reproducing audio information synchronously with a sync signal generated in the MIDI reproducing step; an input step for inputting change information of a musical element when in reproducing; a compensating step for compensating for a delay time generated until change information entered in the input step is reflected in a MIDI audio signal output from the MIDI reproducing means, as well as a delay time generated until the change information is reflected in an audio signal output in the audio reproducing step; and a mixing step for mixing the MIDI audio signal with the audio signal.

In the information processing apparatus in accordance with claim 1, the MIDI reproducing means reproduces MIDI playing information, the audio reproducing means reproduces audio information synchronously with a sync signal generated by the MIDI reproducing means, the input means receives change information of a musical element when in reproducing, the compensating means compensates for a delay time generated until change information entered to the input means is reflected in the MIDI playing signal output from the MIDI reproducing means, as well as a delay time generated until the change information entered to the input means is reflected in the audio signal output from the audio reproducing means, and the mixing means mixes the MIDI playing signals with the audio signal.

In the case of the information processing apparatus in accordance with claim 3 and the supply medium in accordance with claim 4, MIDI playing information is reproduced in the MIDI reproducing step, audio information is reproduced in the audio reproducing step synchronously with a sync signal generated in the MIDI reproducing step, change information of a musical element when in reproducing is entered in the input step, a delay time generated until change information entered in the input step is reflected in the MIDI playing signal output in the MIDI reproducing step, as well as a delay time generated until the above change information is reflected in the audio signal output in the audio reproducing step are compensated in the compensating step, and the MIDI playing signal is mixed with the audio signal in the mixing step.

DESCRIPTION OF THE PREFERRED EMBODIMENTS

Hereunder, the preferred embodiments of the present invention will be described with reference to the accompanying drawings. And, in order to clarify the relationship between each means of the present invention described in claims and each of the embodiments to be described below, the corresponding embodiment (only as an example) will be described in the parentheses added after each means so as to describe the characteristics of the present invention. Such the description does not limit each means only to the described one, however.

Figure 1:
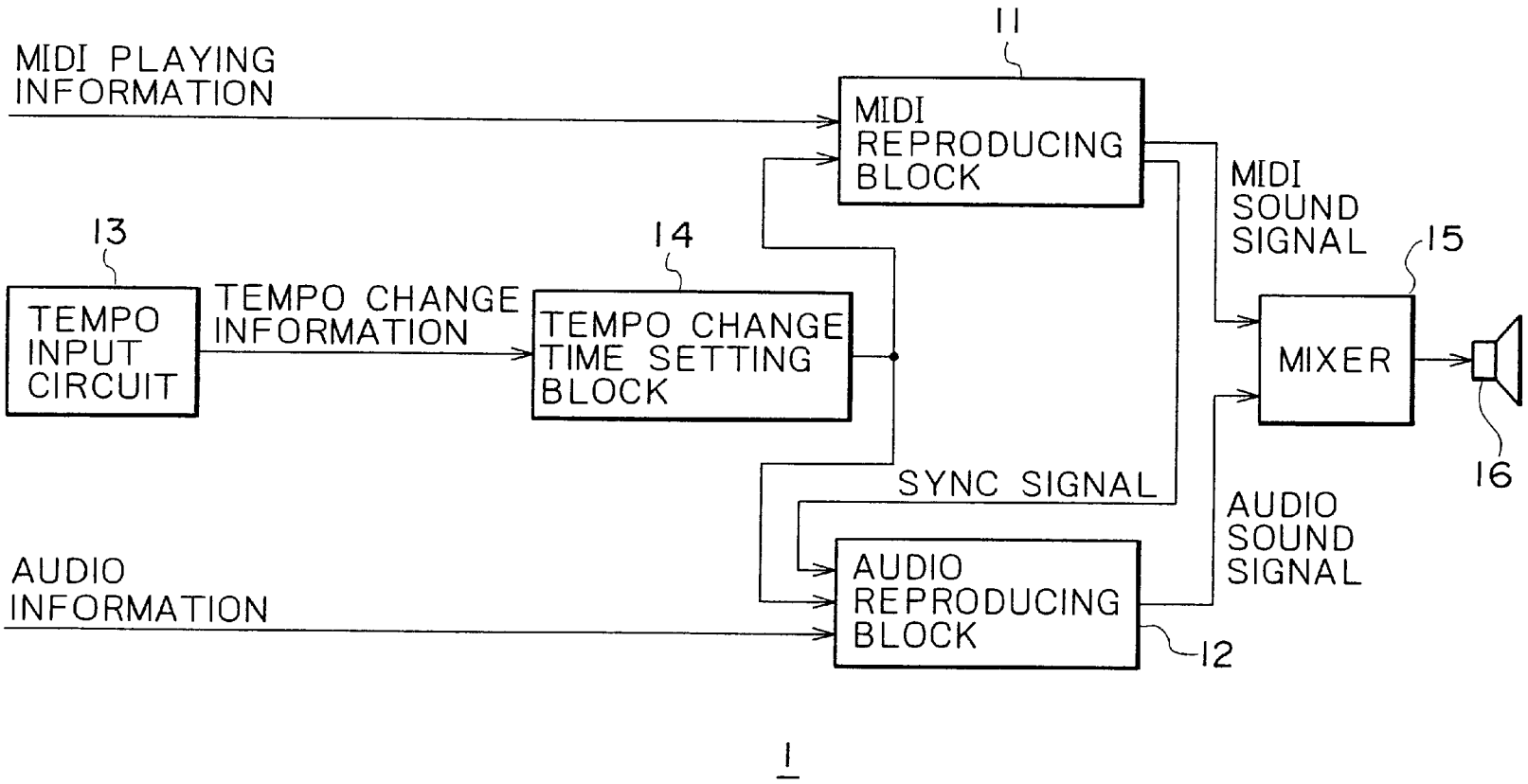
FIG. 1 is a block diagram of a music reproducing apparatus in the first embodiment of the present invention.

More concretely, the information processing apparatus in accordance with claim 1, which is used for reproducing both MIDI playing information and audio information, is characterized by including the following means, that is, MIDI reproducing means for reproducing MIDI music playing information (for example, the MIDI reproducing block 11 shown in FIG. 1); audio reproducing means for reproducing audio information synchronously with a sync signal generated by the MIDI reproducing means (for example, the audio reproducing block 12 shown in FIG. 1); input means for inputting change information of a musical element when in reproducing (for example, the tempo input means 13 shown in FIG. 1); compensating means for compensating for a delay time until change information entered to the input means is reflected in a MIDI audio signal output from the MIDI reproducing means, as well as a delay time until said change information is reflected in an audio signal output from the audio reproducing means (for example, the tempo change time setting block 14 shown in FIG. 1); and mixing means for mixing the MIDI audio signal with the audio signal (for example, the mixer 15 shown in FIG. 1).

FIG. 1 is a block diagram of the music reproducing apparatus in the first embodiment of the present invention. The MIDI reproducing block 11 receives MIDI playing information (musical score information), for example, read from an SMF (Standard MIDI File). The MIDI reproducing block 11 has such a sound source as a synthesizer used to synthesize and reproduces electronic sounds sequentially according to entered MIDI playing information (for example, accompaniment music information), then generates MIDI sound signals of the object accompaniment music. The generated MIDI sound signals are supplied to the mixer 15. MIDI mentioned here means standards of both hardware and software defined so as to enable information to be exchanged with such linked instrumental sound sources as synthesizer, electronic piano, etc.

The audio reproducing block 12 receives audio information (for example, chorus information) to be reproduced synchronously with MIDI playing information. The audio reproducing block 12 reproduces audio signals according to entered audio information. Audio information, which is PCM information, is compressed, for example, using such an information compression method as MPEG before it is supplied to the audio reproducing block 12. The audio reproducing block 12 then expands, decodes, and reproduces the supplied audio information. Generated audio signals are supplied to the mixer 14.

The tempo change time setting block 14 sets a tempo change time in tempo change information entered from the tempo input block 13. The tempo change information, after a tempo change time is set therein, is supplied to both MIDI reproducing block 11 and audio reproducing block 12.

The mixer 15 mixes supplied MIDI sound signals with audio signals, thereby generating reproduction signals and outputs the signals after the sound volume is adjusted. Generated reproduction signals are supplied to the speaker 16, which then outputs the supplied reproduction signals as sounds.

Figure 2:
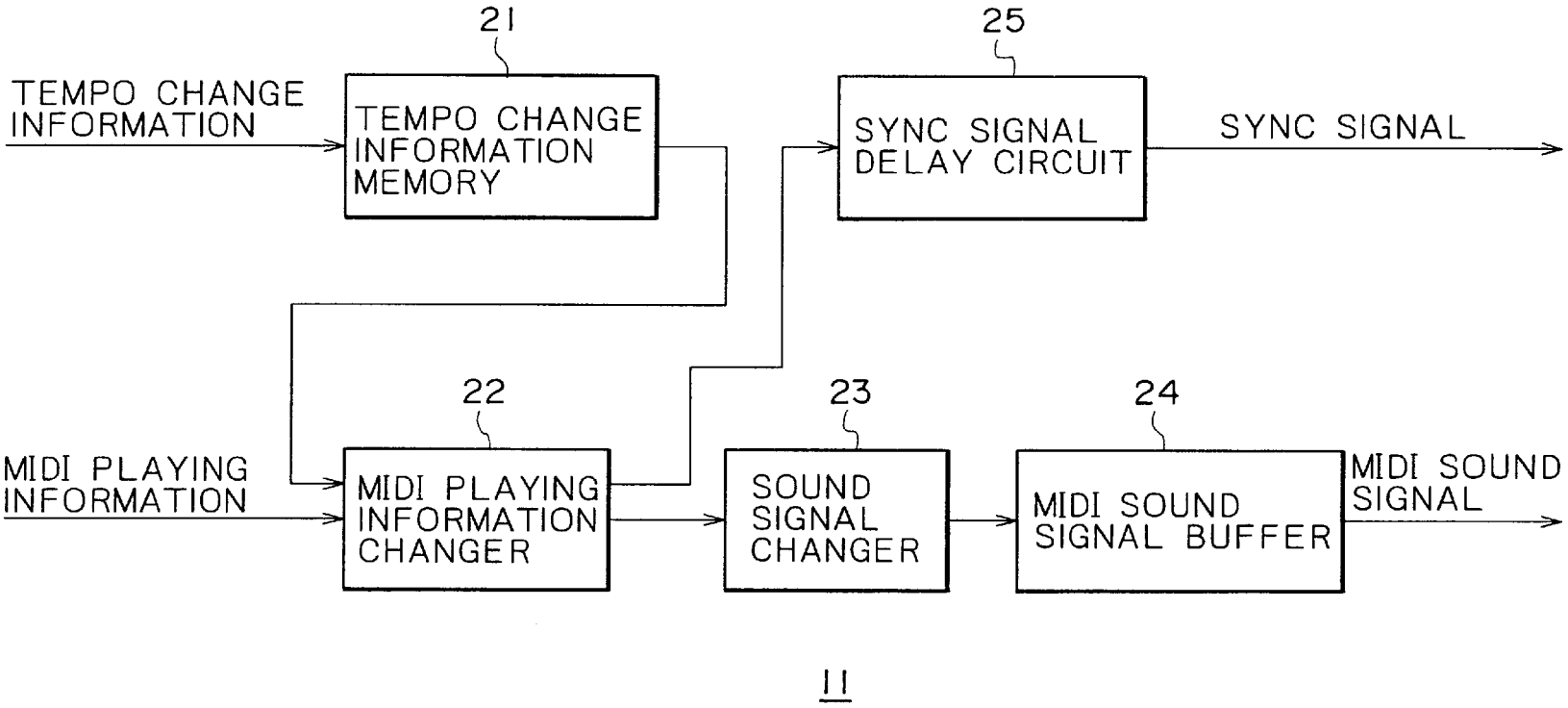
FIG. 2 is a block diagram of a MIDI reproducing block.

FIG. 2 is a block diagram of the MIDI reproducing block 11. The tempo change information memory 21 stores tempo change information supplied from the tempo change time setting block 14 and supplies the tempo change information to the MIDI playing information changer 22. The MIDI playing information changer 22 changes MIDI playing information according to the tempo change information supplied from the tempo input block 13. The changed MIDI playing information is then supplied to a sound signal converter 23. The MIDI playing information changer 22 also generates a sync signal and supplies the signal to the sync signal delaying block 25.

The sound signal converter 23 provided with a synthesizer in itself synthesizes electronic sounds according to supplied MIDI playing information, thereby reproducing audio sounds. Generated MIDI sound signals are supplied to the MIDI sound signal buffer 24. The MIDI sound signal buffer 24 stores supplied MIDI sound signals temporarily, then outputs the signals.

The sync signal delaying block 25 delays the supplied sync signal only by a predetermined delay time, then outputs the delayed sync signal. This delay time is set to an intermediate value between the time when MIDI playing information output from the MIDI playing information changer 22 is entered to the sound signal converter 23 and the time when the information is output from the MIDI sound signal buffer 24 (times corresponding to both of the processing time of the sound signal converter 23 and the processing time of the MIDI sound signal buffer 24).

Figure 3:
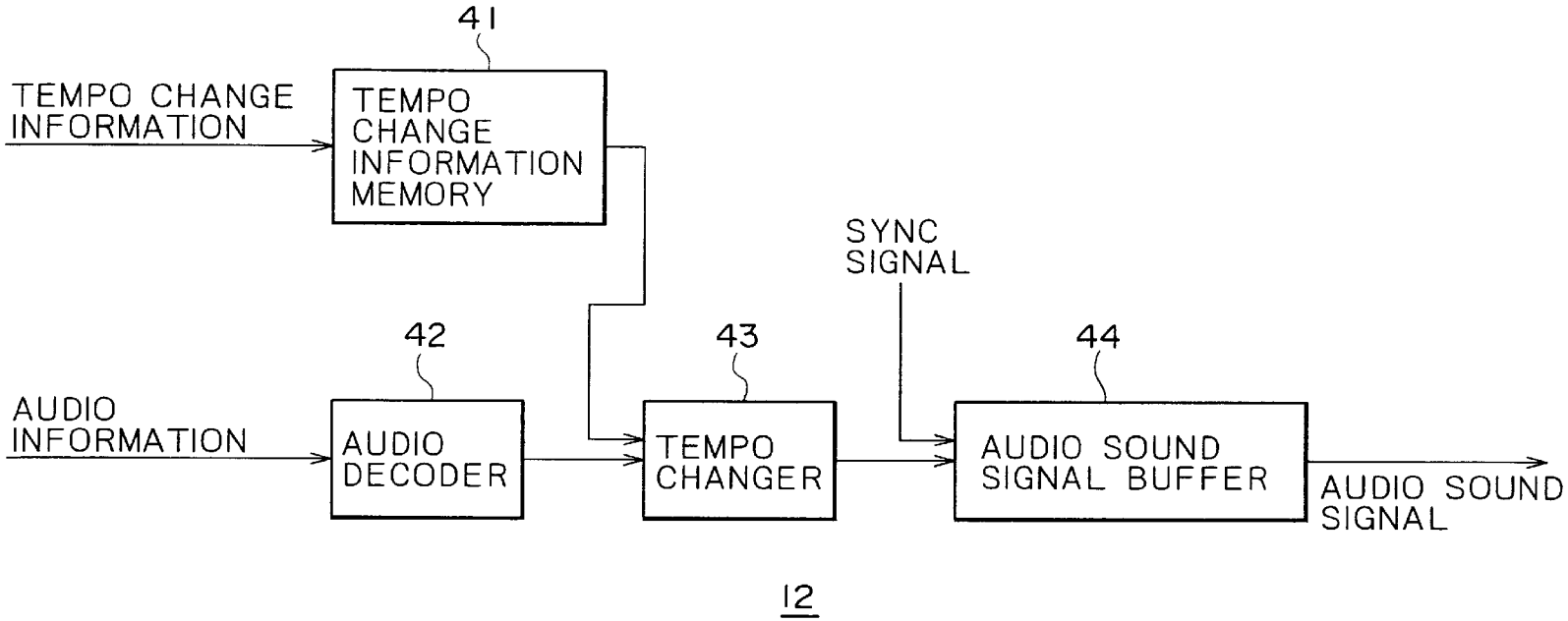
FIG. 3 is a block diagram of an audio reproducing block.

FIG. 3 is a block diagram of the audio reproducing block 12. The tempo change information memory 41 stores tempo change information supplied from the tempo change time setting block 14, then supplies the stored tempo change information to the tempo changer 43. The audio decoder 42 decodes supplied audio information (for example, audio information obtained by compressing encoded PCM or ADPCM (Adaptive Differential PCM) signals or parameters for synthesizing voices), thereby generating audio signals. Generated audio signals are supplied to the tempo changer 43.

The tempo changer 43 changes the tempo of audio signals supplied from the audio decoder 42 according to the tempo change information supplied from the tempo change information memory 41. Tempo-changed audio signals are supplied to the audio signal buffer 44.

The audio signal buffer 44 stores supplied audio signals temporarily, then outputs the stored signals synchronously with the sync signal supplied from the MIDI reproducing block 11.

Figure 4:
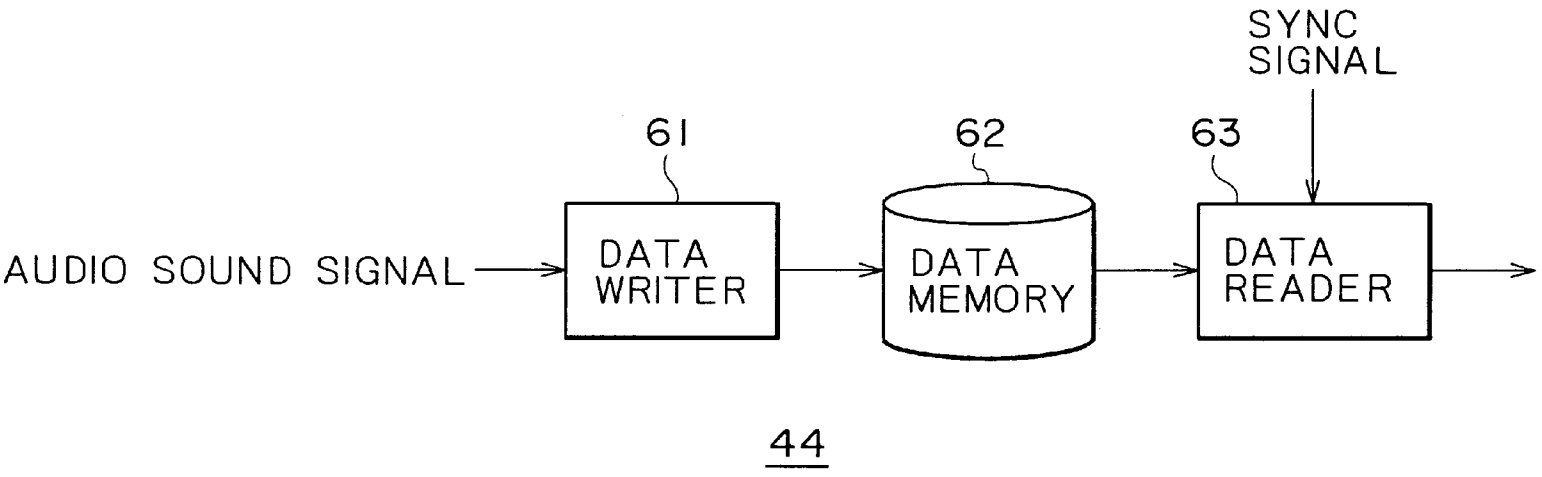
FIG. 4 is a block diagram of an audio signal buffer 44.

FIG. 4 is a block diagram of the audio signal buffer 44. A data writer 61 writes audio signals supplied from the tempo changer 43 or the audio decoder 42 in a data memory 62. A data reader 63 reads audio signals written in the data memory 62 synchronously with a sync signal.

Basically, the above MIDI sound signal buffer 24 may also be composed just like that shown in FIG. 4.

Figure 5:
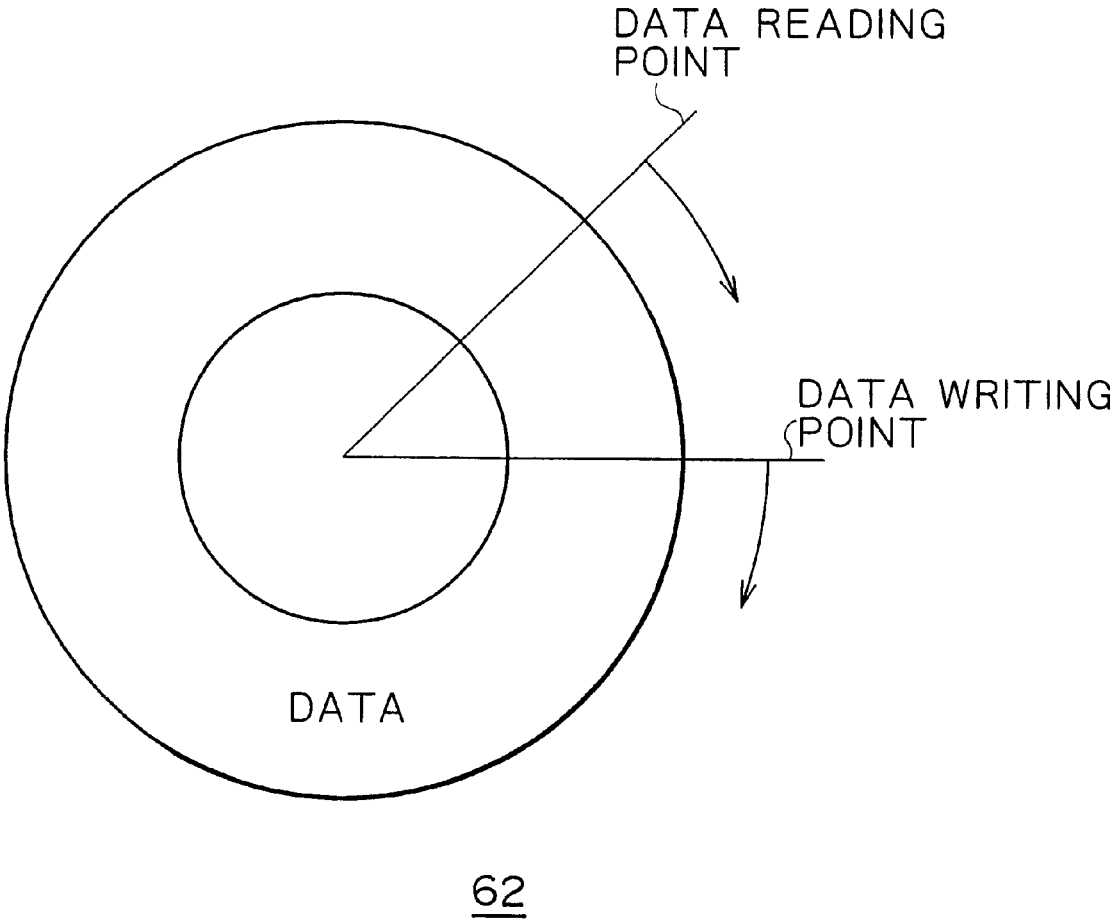
FIG. 5 is a chart for describing a data memory 62.

The data memory 62 is structured as a buffer, for example, as shown in FIG. 5. A ring buffer is a memory provided with a predetermined capacity and composed so that data is written therein and read therefrom cyclically. In addition, the ring buffer can specify a data writing point and a data reading point independently of each other. If audio signals are to be handled, the data reading point is moved forward (to the right) sequentially in correspondence to the reproducing rate of audio signals (sampling frequency) as shown in FIG. 5. The data writing point is kept in the same position or moved forward from the position with respect to the data reading point (the writing point never passes the reading point, however). This is why audio information can be reproduced without any break of sounds.

If the time length of the data to buffer is decided as T44 in the audio signal buffer 44, then the value becomes equal to the data amount positioned between the data reading point and the data writing point. The maximum value becomes equal to a time equivalent to the ring buffer size.

Next, a repetitive reproducing method used for changing a tempo of audio signals will be described. If the repetitive reproducing method is used, the tempo changer 43 reads N samples of audio information and outputs N/a samples, thereby changing the tempo of audio signals. In this case "a" is a parameter of a change rate increased/decreased from the original reproducing rate. It is defined as follows in the expression (1).

$$a = \text{reproducing rate}/\text{original reproducing rate} \quad (1)$$

According to the above expression (1), if the tempo is slowed down, the "a" value becomes $a<1$ and if the tempo is speeded up, the "a" value becomes $a>1$. While the same tempo is kept, the "a" value keeps $a=1$.

For example, if a tempo of audio signals is changed to $a=2/3$ (the tempo slows down), the tempo changer 43 reads N samples of the audio information and outputs 3N/2 samples. More concretely, the tempo changer 43 reads N samples of the audio information and reproduces the samples, one and a half samples at a time repetitively. In this case, the number of samples to be output becomes larger than the number of read samples, thereby the tempo is slowed down.

If a tempo of audio signals is changed to $a=2$ (the tempo is speeded up), the tempo changer 43 reads N samples of the audio information and outputs N/2 samples. More concretely, the tempo changer 43 reads N samples of the audio information and outputs a half of the samples. In this case, the number of output samples becomes smaller than the number of read samples, thereby the tempo can be speeded up.

The above N value is selected so as not to cause the listener to have a feeling of wrongness when in listening to audio sounds. In addition, a cross-fading processing, that is, a processing for overlapping the next sample on the last sample will be performed sometimes when audio sound signals are output.

Next, description will be made for conditions for synchronizing audio sound signals output from the audio reproducing block 12 with MIDI sound signals output from the MIDI reproducing block 11 if a tempo is changed.

There are two conditions for synchronizing audio sound signals with MIDI sound signals. The first condition is starting reproduction of audio sound signals immediately after the audio sound signal buffer 44 receives a sync signal from the MIDI reproducing block section 11. The second condition is changing of the tempos of both MIDI sound signal output from the MIDI reproducing block 11 and audio sound signal output from the audio reproducing block 12 at the same clock time.

Figure 6:
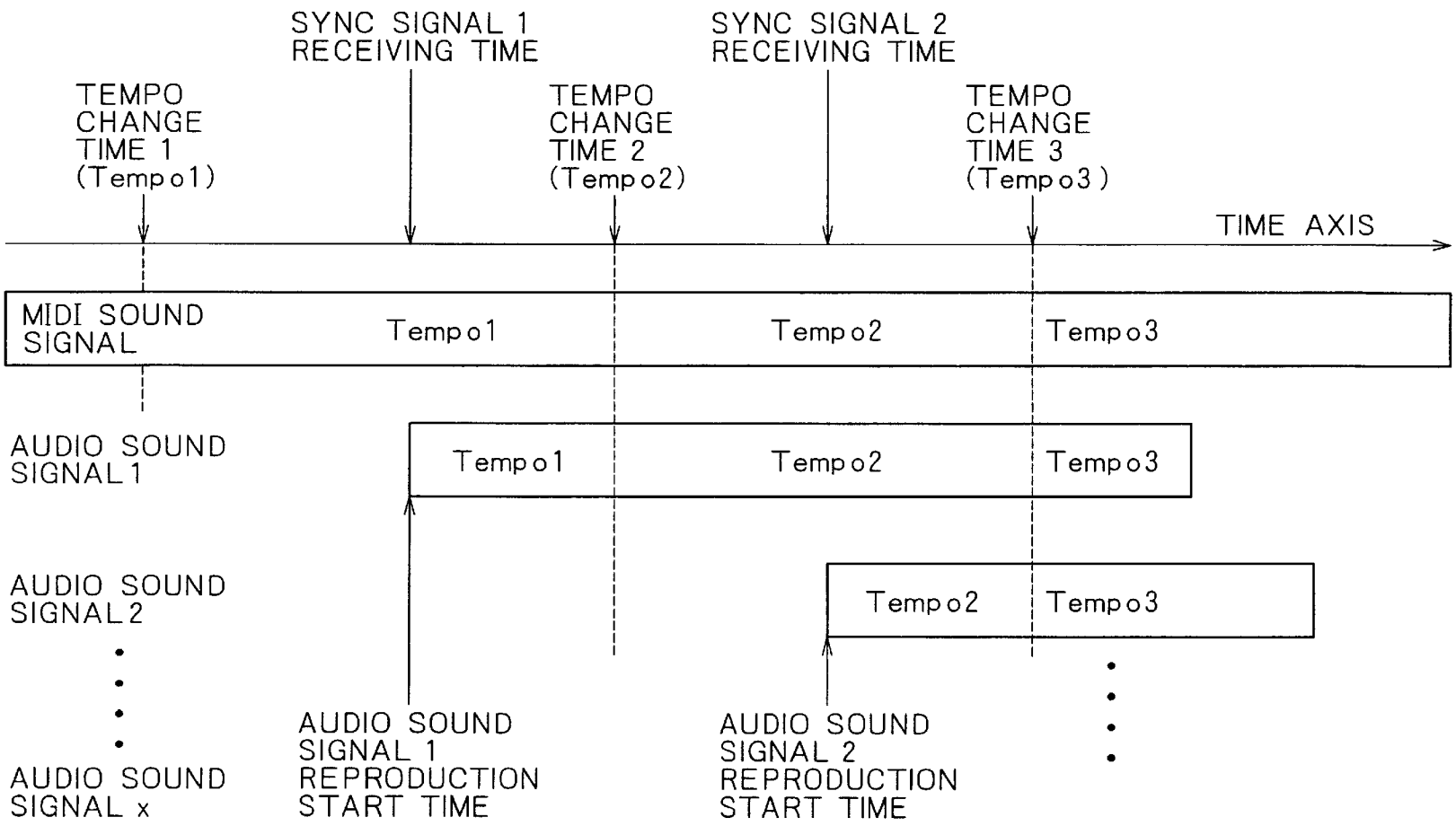
FIG. 6 is a chart for describing conditions for synchronizing audio signals with MIDI playing signals.

For example, as shown in FIG. 6, if a MIDI sound signal is synchronized with both audio sound signal 1 and audio sound signal 2 for reproduction, the first condition is starting reproduction of both audio sound signals 1 and 2 immediately after the audio sound signal buffer 44 receives sync signals 1 and 2 for starting reproduction of both audio sound signals 1 and 2. The second condition is changing of the tempos of all of the MIDI sound signal and audio sound signals 1 and 2 at the same clock time when those tempos are to be changed to Tempo1, Tempo2, and Tempo3 at the tempo change clock times 1, 2, and 3.

Next, the operation of the audio reproducing block 12 for satisfying the above first condition will be described.

Receiving audio information before a reproducing processing is to be performed, the audio decoder 42 decodes a predetermined part in the starting portion of the supplied audio information, then supplies the generated audio sound signal to the tempo changer 43. The tempo changer 43 then changes the tempo of the supplied audio sound signal and supplies the tempo-changed audio sound signal to the audio sound signal buffer 44. The audio sound signal buffer 44 stores the supplied audio sound signal temporarily.

The above series of processes is referred to as a pre-decoding processing. Data generated in such a pre-decoding processing is referred to as pre-decoded data (time length: T44(pre)). This pre-decoding processing enables reading and reproducing of pre-decoded data from the data memory 62 to be started immediately after the audio sound signal buffer 44 receives a sync signal from the MIDI reproducing block 11.

Furthermore, to perform a pre-decoding processing, the audio decoder 42 and the tempo changer 43 perform a filtering processing respectively to analyze signals. And, unnecessary samples are added to the start of each filtering result at this time. The audio decoder 42 and the tempo changer section 43 suppresses the output of those unnecessary samples.

If the times required for generating pre-decoded data in the audio decoder 42 and the tempo changer 43 are T42(pre) and T43(pre), then the pre-decoded data generating time becomes the sum of (T42(pre)+T43(pre)). Generally, the condition on which the audio reproducing block 12 can reproduce data in real time is to satisfy the relationship in the following expression (2) with respect to the time required for generating predetermined data (data length: T44) if the times required for the processes in the audio decoder 42 and in the tempo changer 43 are T42 and T43. This is because the processing rates of the audio decoder 42 and the tempo changer 43 are faster than or equal to the reproducing rate of audio sound signals.

$$T42+T43 \leqq T44 \tag{2}$$

At this time, the relationship in the following expression (3) is satisfied among T42(pre), T43(pre), and T44(pre), which are pre-decoding processing times.

$$T42(\text{pre})+T43(\text{pre}) \leqq T44(\text{pre}) \tag{3}$$

Figure 7:
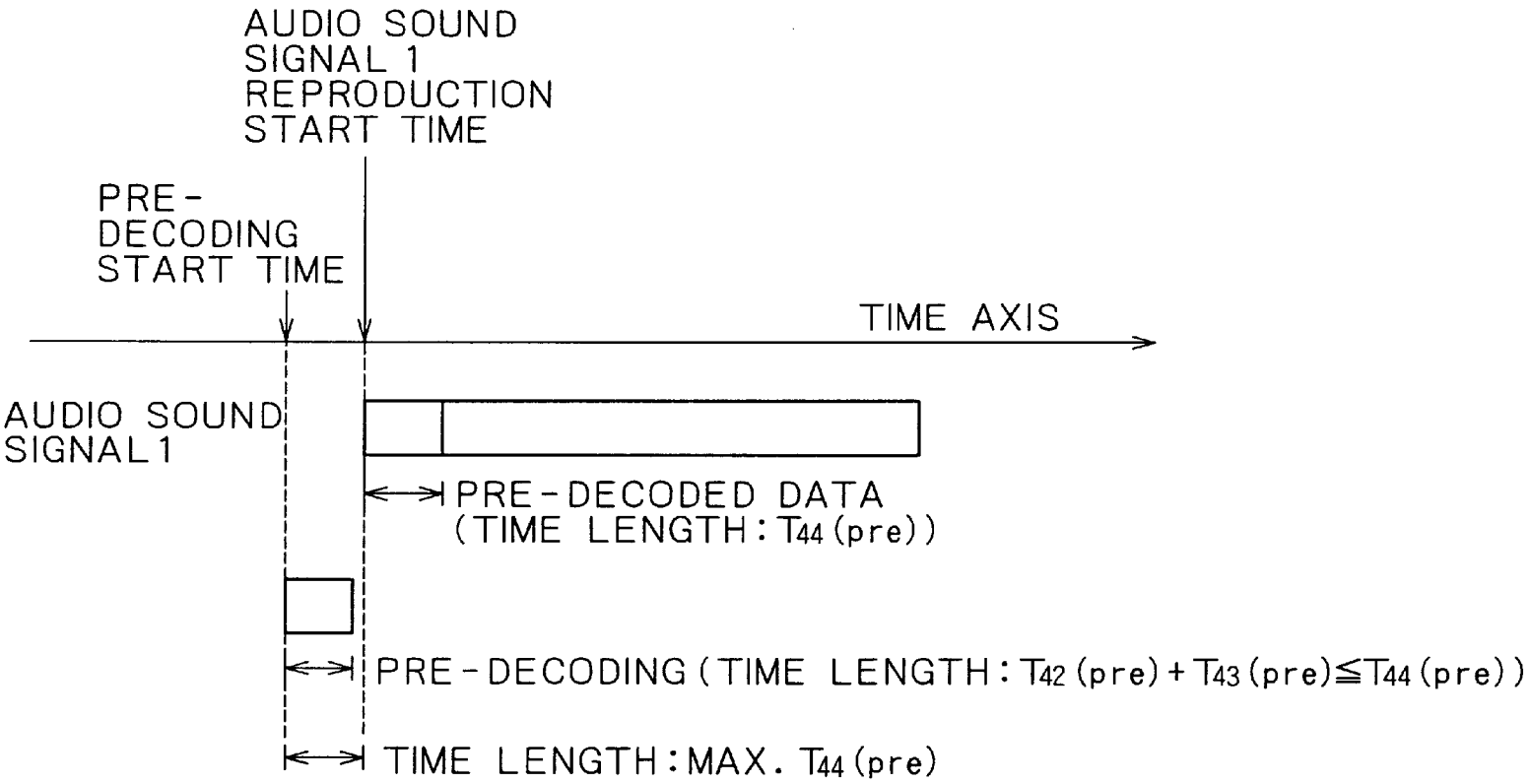
FIG. 7 is a chart for describing a pre-decoding processing.

The above expression (3) indicates that the sum of the times required for pre-decoding processes in the audio decoder 42 and in the tempo changer 43 is T44(pre) is maximum. Consequently, as shown in FIG. 7, it will be understood that it is only needed to set the start time of pre-decoding processing earlier only by T44(pre), which is the start time for reproducing the audio sound signal 1.

Next, the MIDI reproducing block 11, the audio reproducing block 12, and the tempo change time setting block 14 for satisfying the above second condition will be described more in detail.

The tempo change time setting block 14 sets a time T(offset) in received tempo change information so as to eliminate the time difference between a delay time D11 required until the tempo change information is reflected in the MIDI sound signal output from the MIDI reproducing block 11, as well as a delay time D12 required until the tempo change information is reflected in the audio sound signal output from the audio reproducing block 12. The time T(offset) indicates a time required until the tempo change information is reflected in both MIDI sound signal and audio sound signal. Consequently, the conventional problem, that is, the difference between the delay times D11 and D12 can be eliminated. The T(offset) is set so as to satisfy the following expression (4) at this time.

$$T(\text{offset}) \geqq \text{the maximum values of D11 and D12} \tag{4}$$

Consequently, the tempo change time supplied to the MIDI playing information changer 22 becomes a time delayed just by T(offset) from the MIDI sound signal output from the MIDI sound signal buffer 24 at that time. In the same way, the tempo change information supplied to the tempo changer 43 becomes a time delayed just by T(offset) from the audio sound signal output from the audio sound signal buffer 44 at that time. In this case, the following relationship in the expression (44) is satisfied.

$$T(\text{offset}) \geqq D11$$

$$T(\text{offset}) \geqq D12$$

The tempo change information is thus reflected correctly in both MIDI sound signal and audio sound signal, thereby the tempos of both MIDI sound signal and audio sound signal are changed at the same point of time, assuring that both signals are synchronized accurately.

The tempo change information memory 21 stores (delays) supplied tempo change information only for a time (T(offset)−D11), then supplies the information to the MIDI playing information changer 22. In the same way, the tempo change information memory 41 stores (delays) supplied tempo change information only for a time (T(offset)−D12), then supplies the information to the tempo changer 43. At this time, the delay times D11 and D12 are represented as shown below in the expressions (5) and (6) respectively.

$$D11=T22+T23+T24 \quad (5)$$

$$D12=T43+T44 \quad (6)$$

T22 and T23 indicate data processing times in the MIDI playing information changer 22 and in the sound signal changer 23. T24 indicates a time equivalent to a data length to be buffered in the MIDI sound buffer 24. T43 indicates a data processing time in the tempo changer 43. T44 indicates a time equivalent to a data length to be buffered in the audio sound signal buffer 44.

Next, a circuit designing method will be described. The method is used to synchronize audio sound signals in the MIDI reproducing block 11 with the use of a hardware MIDI sound source.

The hardware MIDI sound source is equivalent to the sound signal converter 23 and the MIDI sound signal buffer 24. If such a hardware MIDI sound source is employed, a time (T23+T24) required until entered MIDI playing information is converted to a MIDI sound signal is almost equal to 0, so D11 may be considered to be D11=T22 from the expression (5). The following expression (7) is obtained from the expression (2).

$$T43 \leqq T44-T42 \quad (7)$$

The above expression (7) is substituted for expression (6) to obtain the expression (8).

$$D12 \leqq (T44-T42)+T44 \quad (8)$$

The expression (9) is obtained from the above expression (8) as follows.

$$D12 \leqq 2\times T44-T42 \quad (9)$$

The maximum value of D11 is T22 and the maximum value of D12 is (2×T44). In this case, for example, if T(offset) is set to 1.0 sec, the following expressions (10) and (11) are obtained from the expression (4), since T22 is smaller than T(offset).

$$\text{T(offset)} \geqq \text{Maximum value of D12} \quad (10)$$

$$\text{T(offset)} \geqq 2\times T44 \quad (11)$$

If T(offset) is set to 1.0 sec., T44=0.5 sec. can be set in maximum according to the above expression (11). More concretely, the data length to be buffered in the audio sound signal buffer 44 can be set to 0.5 sec. in maximum. At this time, it is only needed to set the pre-decoding start time to a time 0.5 sec. before the time when reproduction of the audio sound signal 1 is started.

The above T(offset) value may also be set to a value other than 1.0 sec. However, if the T(offset) value is excessively small, the pre-decoding processing will not be done correctly (the pre-decoding length will become shorter than the minimum data length of the audio decoder 42). In addition, if the T(offset) value is excessively large, the delay time required until the object tempo change information is reflected in the audio sound signal is increased. The above items are taken into consideration to set the T(offset) value.

Next, another circuit designing method will be described. The method is employed for synchronizing audio sound signals in the MIDI reproducing block 11 with the use of a software MIDI sound source. The software MIDI sound source mentioned here is a sound source for emulating a hardware sound source in a software manner through arithmetic operations of waveforms, arithmetic operations of filters, etc.

The software MIDI sound source is equivalent to the sound signal converter 23 and the MIDI sound signal buffer 24. When compared with the above hardware MIDI sound source, however, the time (T23+T24) required until entered MIDI playing information is converted to a MIDI sound signal is large. The T(offset) value, therefore, is decided by comparing D11 with D12 in value. The delay time D25 set in the sync signal delay circuit 25 is represented as follows in the expression (12).

$$D25=T23+T24 \quad (12)$$

Figure 8:
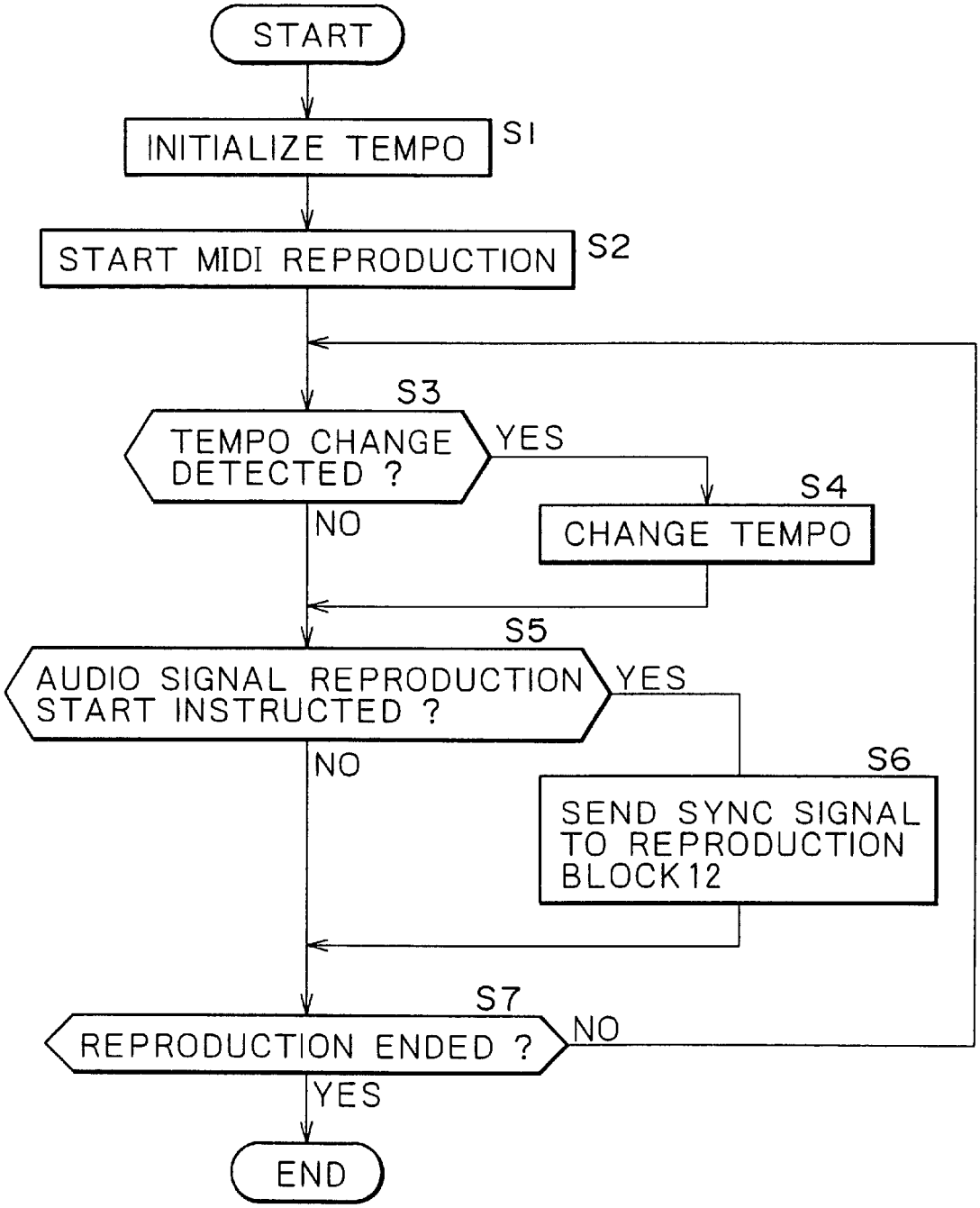
FIG. 8 is a flowchart for describing the operation of the MIDI reproducing block 11.

Next, the processing operation of the MIDI reproducing block 11 will be described with reference to the flowchart in FIG. 8.

At first, if reproduction of MIDI sounds is instructed and MIDI playing information is supplied to the MIDI playing information changer 22, then the MIDI playing information changer 22 initializes the MIDI reproducing tempo and supplies the MIDI playing information to the sound signal converter 23 in step S1.

Then, the sound signal converter 23 starts generation of MIDI sound signals according to the supplied MIDI playing information in step S2. The generated MIDI sound signals are supplied to the MIDI sound signal buffer 24. The signals are stored there temporarily, then output to the mixer 15.

If the user operates the tempo input block 13 to change a tempo, the tempo change information is supplied to the MIDI playing information changer 22 from the tempo changer time setting block 14 via the tempo change information memory 21. Then, the MIDI playing information changer 22 decides in step S3 whether or not a tempo change is detected according to the tempo change information.

If a tempo change is detected in step S3, control goes to step S4, where the MIDI playing information changer 22 changes the tempo for the supplied MIDI playing information. Control then goes to step S5. If no tempo change is detected in step S3, the processing in step S4 is skipped and control goes to step S5.

In step S5, the MIDI playing information changer 22 decides whether or not the supplied MIDI playing information (MIDI event) includes an instruction for starting reproduction of audio sound signals.

If it is decided in step S5 that the start instruction is included in the information, control goes to step S6, where the MIDI playing information changer 22 supplies a sync signal to the sync signal delay circuit 25. The sync signal delay circuit 25 delays the supplied sync signal only by a predetermined time, then supplies the delayed sync signal to the audio reproducing block 12. If it is decided in step S5 that the start instruction is not included in the information, the processing in step S6 is skipped, then control goes to step S7.

In step S7, the MIDI playing information changer 22 decides whether or not the MIDI reproduction is ended. If it is decided in step S7 that the MIDI reproduction is not ended yet, control goes back to step S3, where the subsequent processes are repeated again. If it is decided in step S7 that the MIDI reproduction is ended, the processing operation is ended.

Figure 9:
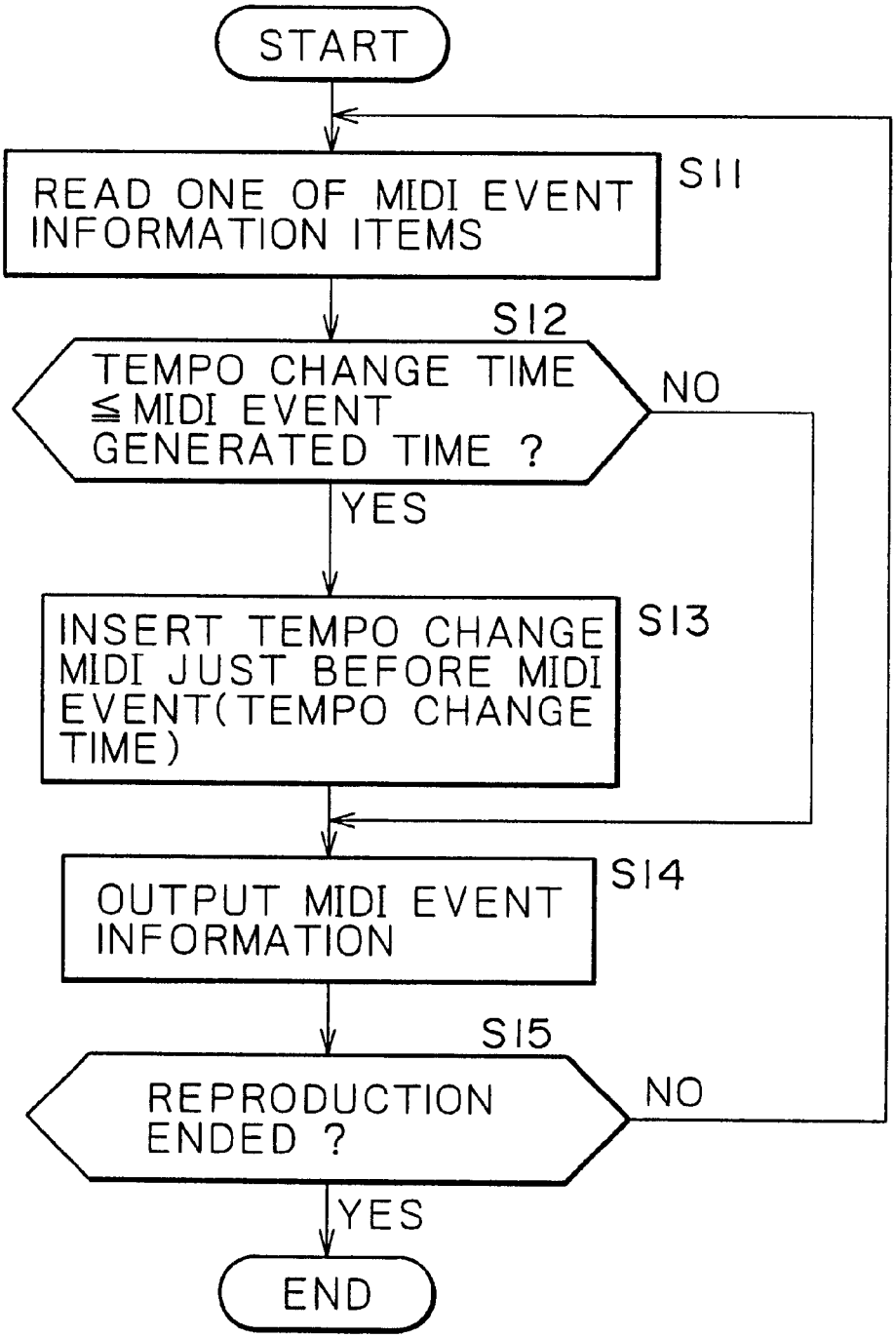
FIG. 9 is a flowchart for describing the operation of a MIDI playing information changer 22.

Next, the processing operation of the MIDI playing information changer 22 will be described with reference to the flowchart in FIG. 9.

At first, if MIDI playing information is supplied to the MIDI playing information changer 22, the MIDI playing information changer reads one of the MIDI event information items in step S11. Control then goes to S12.

In step S12, the MIDI playing information changer 22 decides whether or not the tempo change time (the time set in the tempo change time setting block 14) supplied from the tempo change information memory 21 is earlier than the read MIDI event information generated time.

If it is decided in step S12 that the tempo change time is earlier than the MIDI event information generated time, control goes to step S13, where the MIDI playing information changer 22 inserts a tempo change MIDI event just before the MIDI event information. Control then goes to step S14. If it is decided in step S12 that the tempo change time is not earlier (later) than the MIDI event information generated time, the processing in step S13 is skipped and control goes to step S14.

In step S14, the MIDI playing information changer 22 outputs the processed MIDI event information, then control goes to step S15. In step S15, the MIDI playing information changer 22 decides whether or not reproduction of the supplied MIDI playing information is ended. If decided in step S15 that the reproduction is not ended yet, control goes back to step S11, where the subsequent processes are repeated again. If decided in step S15 that the reproduction is ended, the processing operation is ended.

Figure 10:
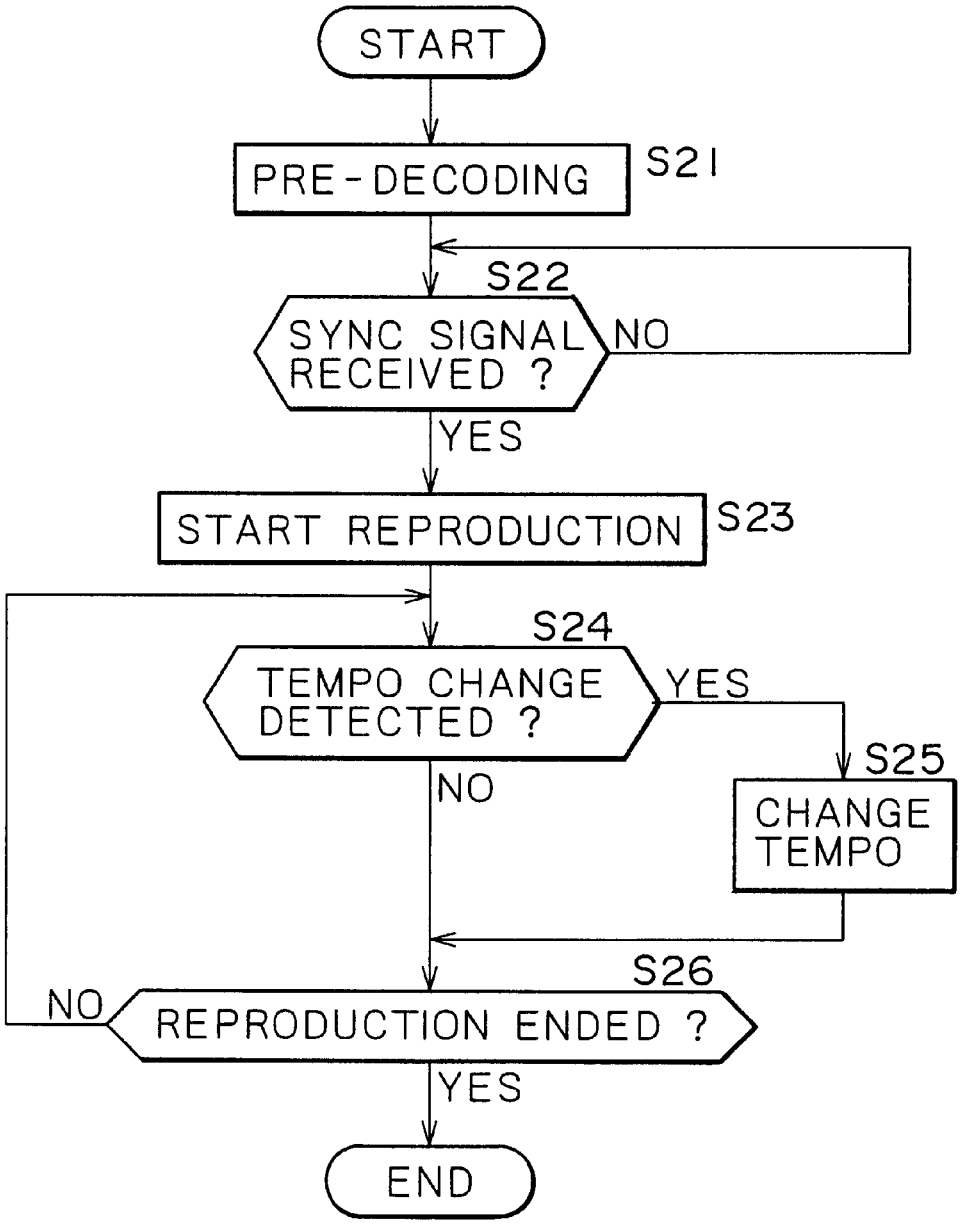
FIG. 10 is a flowchart for describing the operation of the audio reproducing block 12.

Next, the processing operation of the audio reproducing block 12 will be described with reference to the flowchart in FIG. 10.

At first, if audio information is supplied to the audio decoder 42, a pre-decoding processing is performed in step S21. In other words, the audio decoder 42 decodes a predetermined part in the start portion of the supplied audio information, then supplies the decoded information to the audio sound signal buffer 44 via the tempo changer 43.

In step S22, the audio sound signal buffer 44 decides whether or not a sync signal is supplied from the MIDI reproducing block 11.

If decided in step S22 that no sync signal is supplied, control goes back to step S22. If decided in step S22 that a sync signal is supplied, control goes to step S23, where the audio sound signal buffer 44 starts reproduction of the audio information.

In step S24, the tempo changer 43 decides whether or not a tempo change is detected according to the tempo change information supplied from the tempo change information memory 41.

If decided in step S24 that a tempo change is detected, control goes to step S25, where the tempo changer 43 changes the tempo of the supplied audio sound signal, then outputs the tempo-changed audio signal via the audio sound signal buffer 44. If decided in step S25 that no tempo change is detected, the processing in step S25 is skipped, then control goes to step S26.

In step S26, the tempo changer 43 decides whether or not the reproduction of the audio sound signal is ended. If decided in step S26 that the reproduction is not ended yet, control goes back to step S24, where the subsequent processes are repeated again. If decided in step S26 that the reproduction is already ended, the processing operation is ended.

Figure 11:
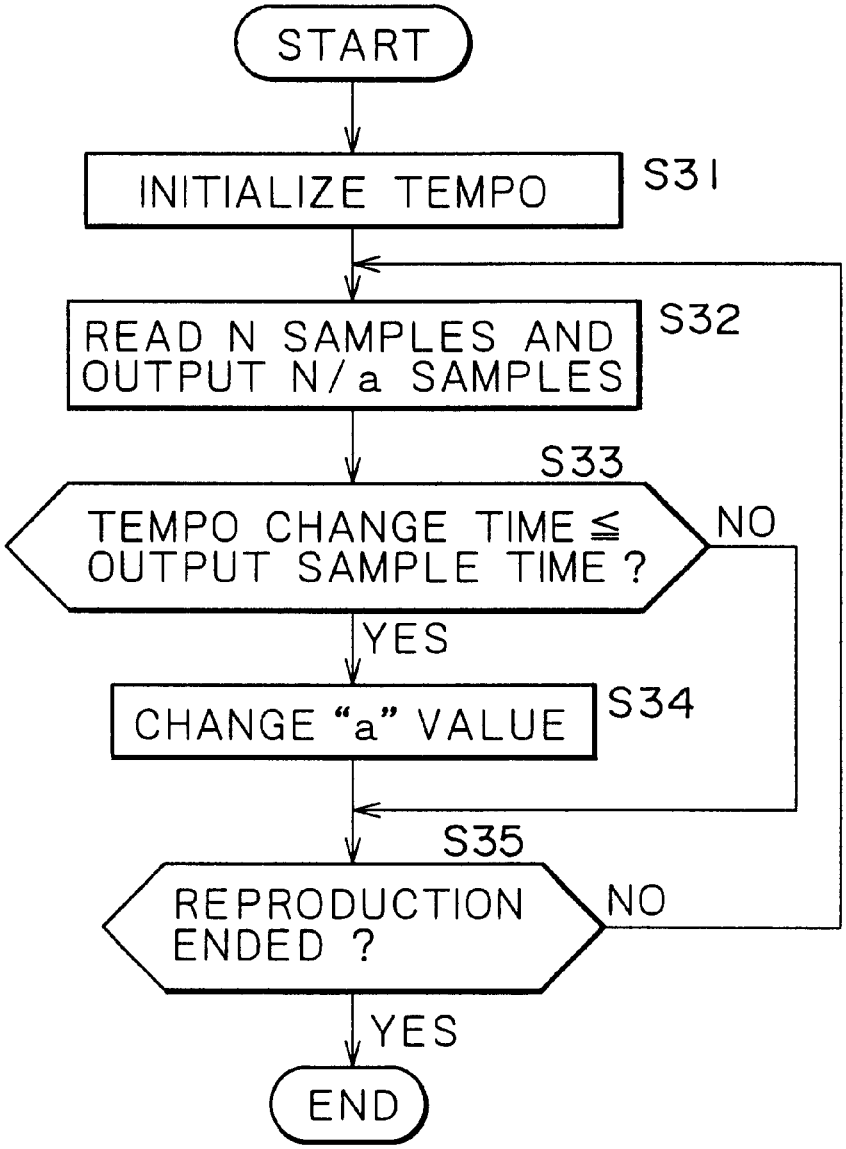
FIG. 11 is a flowchart for describing the operation of a tempo changer 43.

Next, the processing operation of the tempo changer 43 will be described with reference to the flowchart shown in FIG. 11.

If an audio sound signal is supplied to the tempo changer 43, the tempo changer 43 initializes the tempo in step S31 and sets the parameter "a". The parameter "a" is represented as follows in the expression (1) as described above.

In step S32, the tempo changer 43 reads audio information only by N samples, then outputs N/a samples. In other words, the tempo changer 43 changes the tempo with the use of a repetitive reproducing method.

Then, in step S33, the tempo changer 43 decides whether or not the tempo change time supplied from the tempo change information memory 41 (the time set by the tempo change time setting block 14) is earlier than the output sample time.

If decided in step S33 that the tempo change time is earlier than the output sample time, control goes to step S34, where the tempo changer 43 sets the parameter "a" again, then control goes to step S35. If decided in step S33 that the tempo change time is not earlier than the output sample time, then the processing in step S34 is skipped and control goes to step S35.

In step S35, the tempo changer 43 decides whether or not reproduction of the whole entered audio information is ended. If decided in step S35 that the reproduction of the whole entered audio information is not ended yet, control goes back to step S32, where the subsequent processes are repeated again. If decided in step S35 that the reproduction is already ended, the processing operation is ended.

Although a repetitive reproducing method is employed for changing a tempo in the first embodiment, the tempo can be changed with any other methods.

Figure 12:
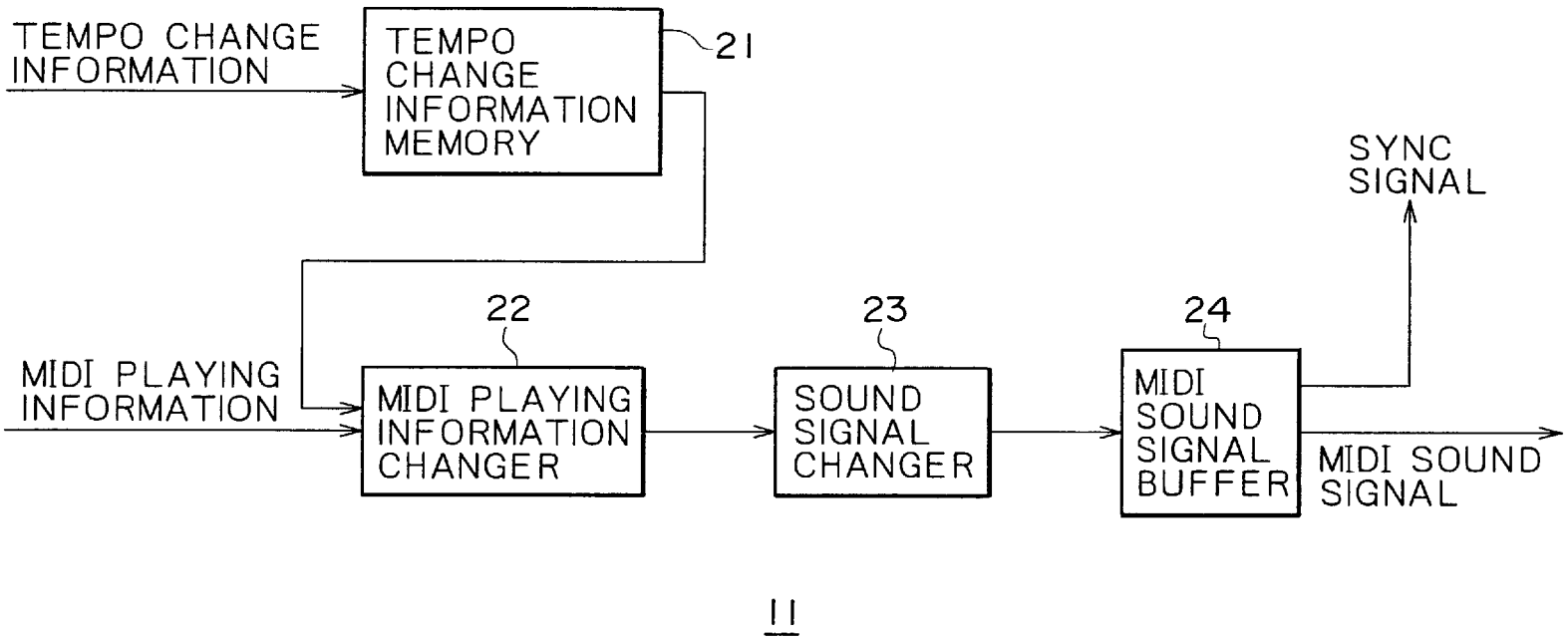
FIG. 12 is another block diagram of the MIDI reproducing block 11.

FIG. 12 is another block diagram of the MIDI reproducing block 11. The block diagram shown in FIG. 12 is the same as that shown in FIG. 12 except for that the sync signal delay circuit 25 is deleted from FIG. 2. The sync signal is output from the MIDI sound signal buffer 24.

Figure 13:
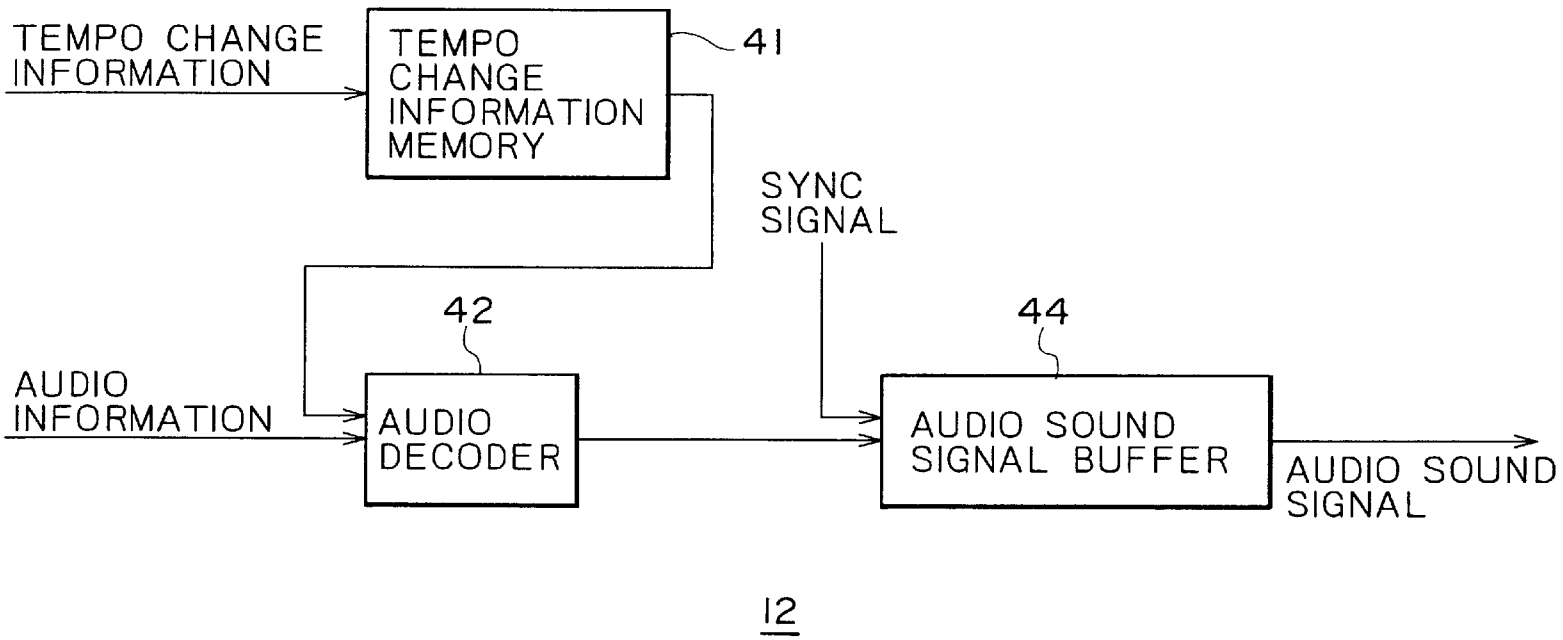
FIG. 13 is another block diagram of the audio reproducing block 12.

FIG. 13 is another block diagram of the audio reproducing block 12. The audio reproducing block shown in FIG. 3 is the same in configuration as that shown in FIG. 3 except that the tempo changer 43 is deleted from FIG. 3. The configuration of the audio reproducing block 12 is realized by using an HVXC (Harmonic Vector Excitation Coding) method for encoding audio information. The HVXC method will be adopted by the MPEG-4 Audio Standard.

The tempo change information memory 41 supplies stored tempo change information to the audio decoder 42. The audio decoder 42 then decodes supplied audio information according to the tempo change information, thereby generating a tempo-changed audio sound signal. The generated audio sound signal is supplied to the audio sound signal buffer 44. The audio sound signal buffer 44 stores the supplied audio sound signal temporarily, then outputs the signal synchronously with a sync signal supplied from the MIDI reproducing block 11.

This completes the description for tempo changes in the first embodiment. Next, key changes in the second embodiment will be described.

Figure 14:
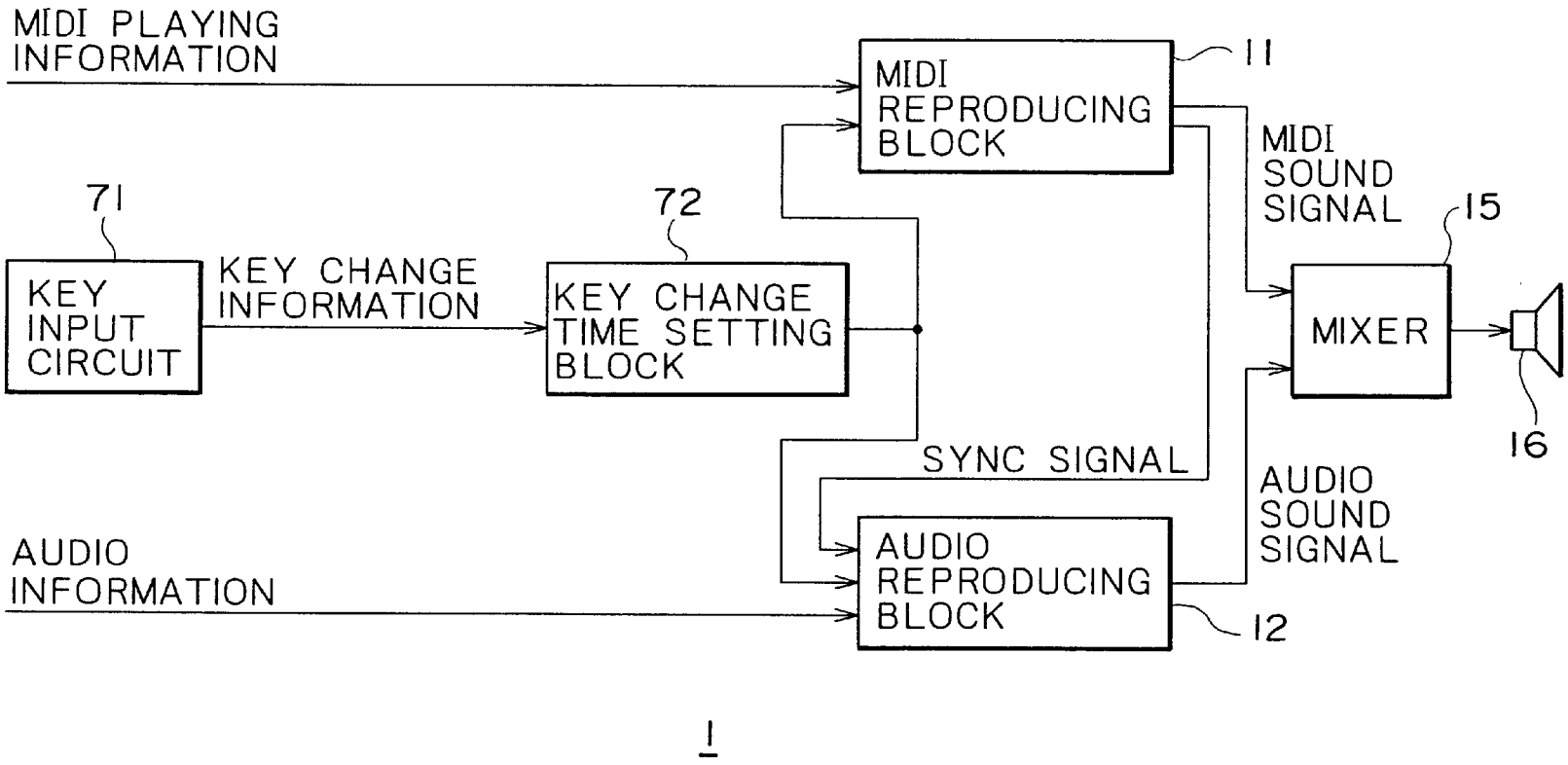
FIG. 14 is a block diagram of the music reproducing apparatus in the second embodiment of the present invention.

FIG. 14 is a block diagram of the music reproducing apparatus 1 in the second embodiment of the present invention. In the music reproducing apparatus shown in FIG. 14, the tempo input circuit 13 and the tempo change time setting block 14 shown in FIG. 1 are replaced with a key input block 71 and a key change time setting block 72 respectively. The key change time setting block 72 sets a predetermined delay time for key change time information included in key change information supplied from the key input block 71. Key change information in which a key change time is set is supplied to both MIDI reproducing block 11 and the audio reproducing block 12 respectively. Other items in FIG. 14 are the same as those in FIG. 1, so the same reference symbols are used for them, avoiding redundant description.

Figure 15:
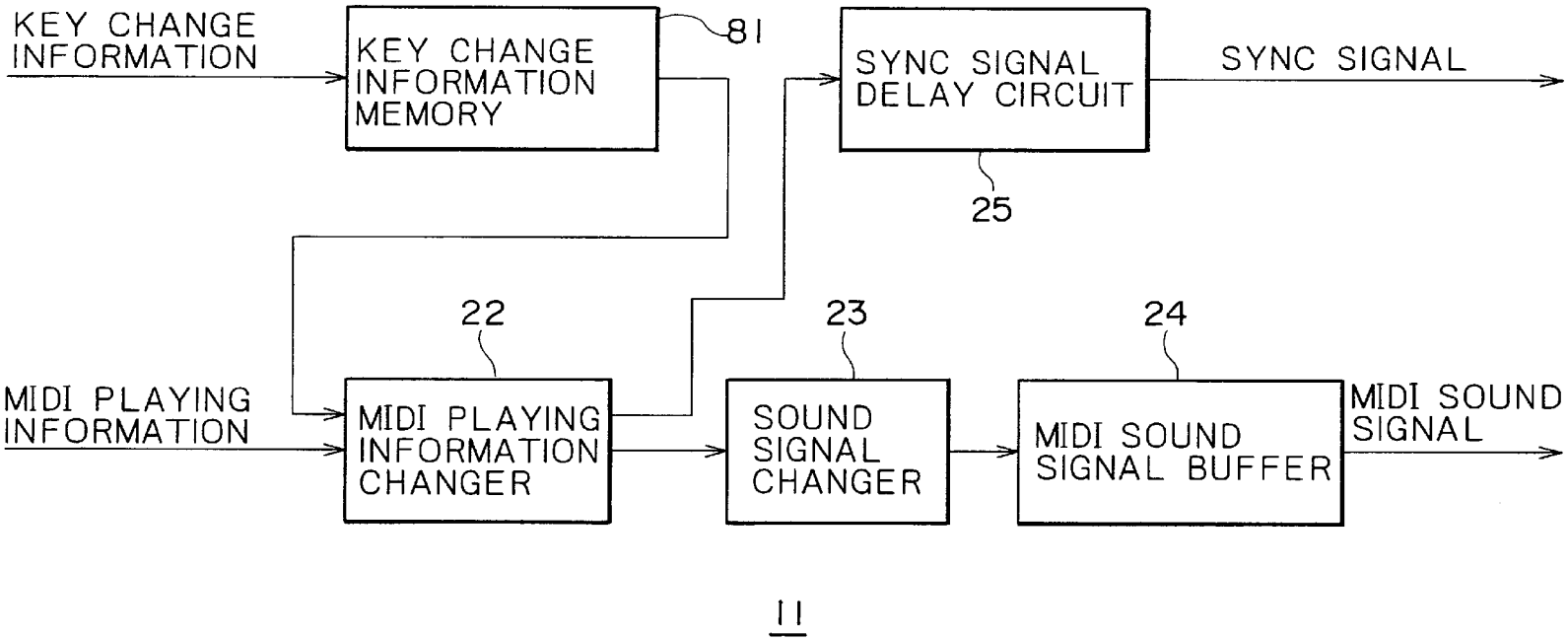
FIG. 15 is further another block diagram of the MIDI reproducing block 11.

FIG. 15 is another block diagram of the MIDI reproducing block 11 shown in FIG. 14. In the MIDI reproducing block 11 shown in FIG. 15, the tempo change information memory 21 shown in FIG. 2 is replaced with a key change information memory 81. The key change information memory 81 stores key change information supplied from the key change time setting block 72 and supplies the stored key change information to the MIDI playing information changer 22. In FIG. 15, the same reference symbols are used for the same items as those in FIG. 2, avoiding redundant description.

Figure 16:
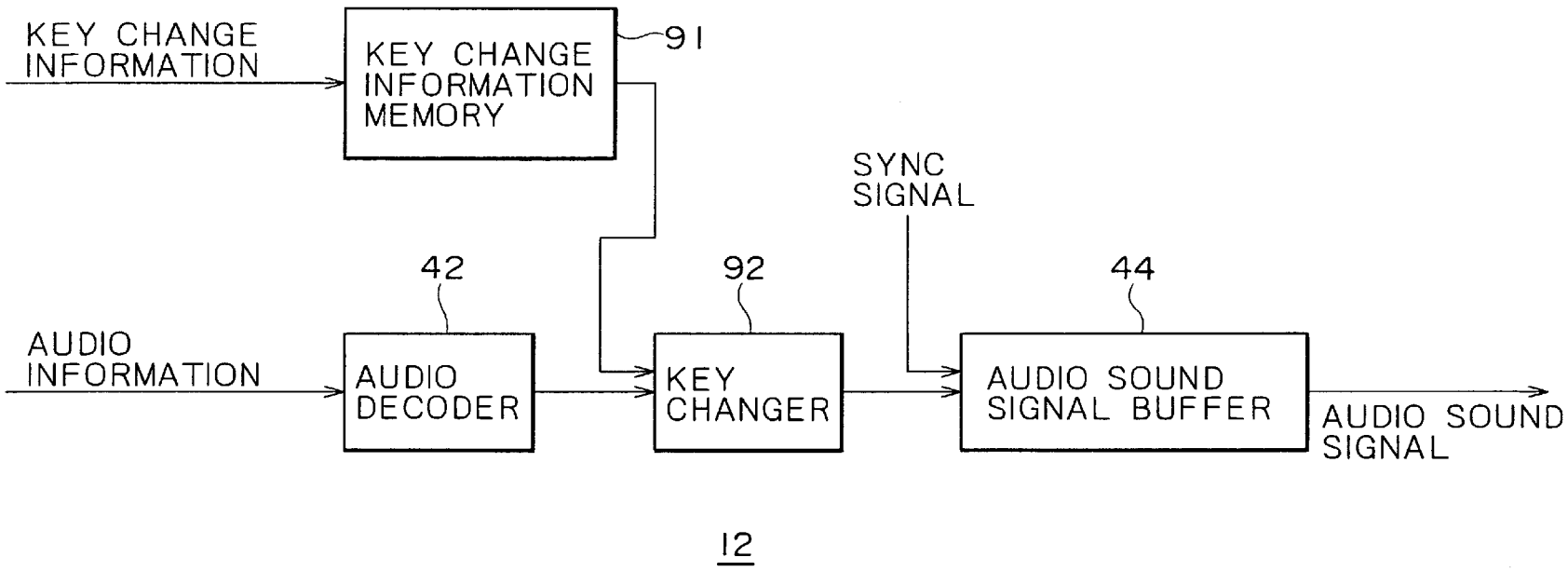
FIG. 16 is further another block diagram of the audio reproducing block.

FIG. 16 is another block diagram of the audio reproducing block shown in FIG. 14. In the audio reproducing block 12 shown in FIG. 16, the tempo change information memory 41 and the tempo changer 43 shown in FIG. 3 are replaced with a key change information memory 91 and a key changer 92 respectively. The key change information memory 91 stores key change information supplied from the key change time setting block 72 and supplies the stored key change information to the key changer 92. The key changer 92 changes the key of an audio sound signal according to supplied key change information. The key changed audio sound signal is supplied to the audio sound signal buffer 44. In FIG. 16, the same reference symbols are used for the same items as those in FIG. 3, avoiding redundant description.

Figure 17:
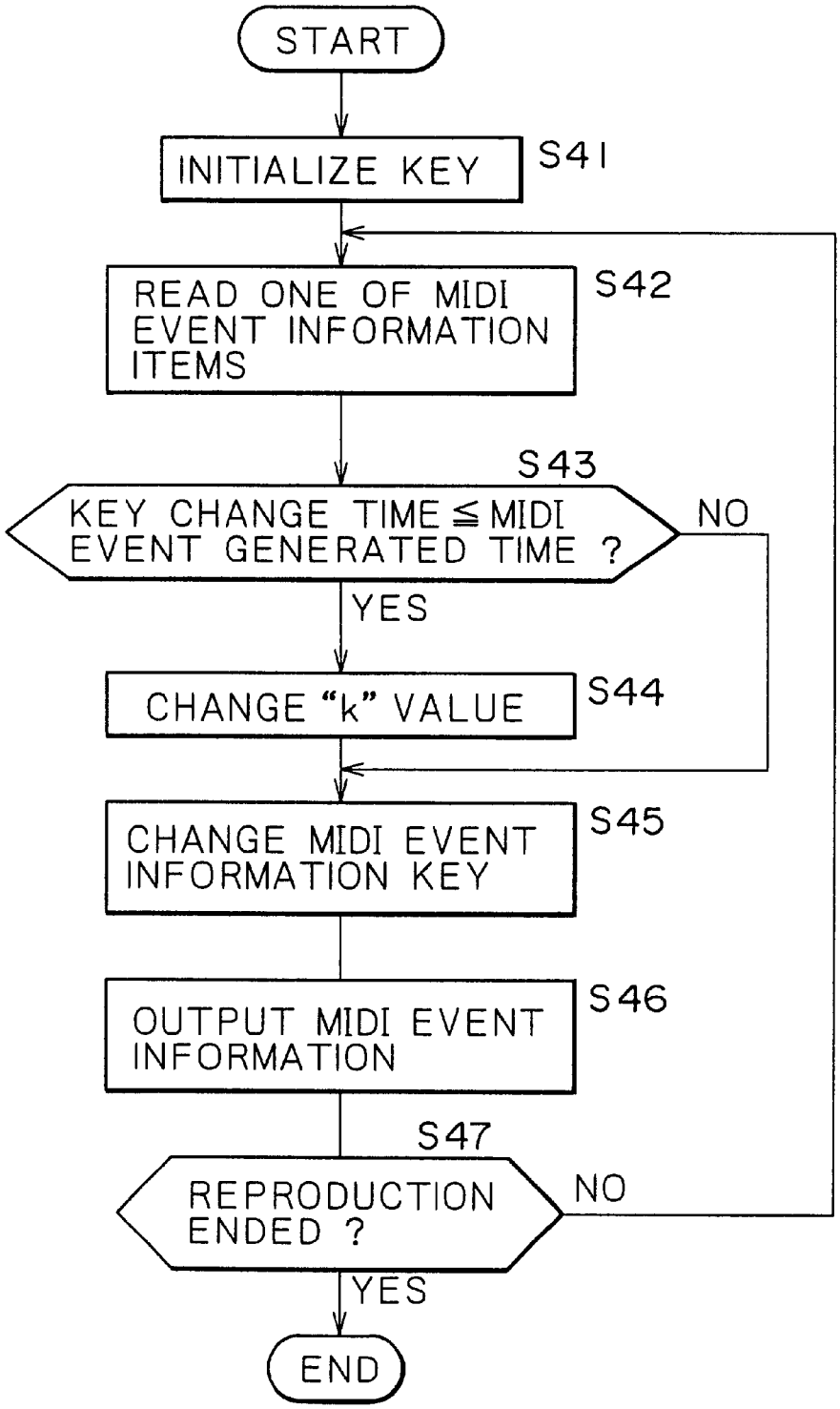
FIG. 17 is a flowchart for describing the operation of the MIDI playing information changer 22.

Next, a key change processing performed in the MIDI playing information changer 22 shown in FIG. 15 will be described with reference to the flowchart shown in FIG. 17.

At first, if a MIDI reproduction processing is instructed, the MIDI playing information changer 22 initializes the key in step S41, then sets the parameter "k". The "k" indicates a change rate increased/decreased from the original reproduction key. The change rate is defined as follows in the expression (13).

$$k = \text{reproduction frequency}/\text{original reproduction frequency} \quad (13)$$

In step S42, the MIDI playing information changer 22 reads one of the MIDI event information items, then control goes to step S43.

In step S43, the MIDI playing information changer 22 decides whether or not the key change time (the time set by the key change time setting block 72) supplied from the key change information memory 81 is earlier than the MIDI event generated time.

If decided in step S43 that the key change time is earlier than the MIDI event generated time, control goes to step S44, where the MIDI playing information changer 22 sets the parameter "k" again. Control then goes to step S45. If decided in step S43 that the key change time is not earlier than the MIDI event generated time, the parameter "k" is not set again. Control then goes to S45.

In step S45, the MIDI playing information changer 22 changes the key information included in the MIDI event information according to the parameter "k". Control then goes to step S46.

In step S46, the MIDI playing information changer 22 outputs the processed MIDI event information. Control then goes to step S47.

In step S47, the MIDI playing information changer 22 decides whether or not reproduction of the whole entered MIDI playing information is ended. If decided in step S47 that the reproduction is not ended yet, control goes back to step S42, where the subsequent processes are repeated again. If decided in step S47 that the reproduction is already ended, the processing is ended.

Figure 18:
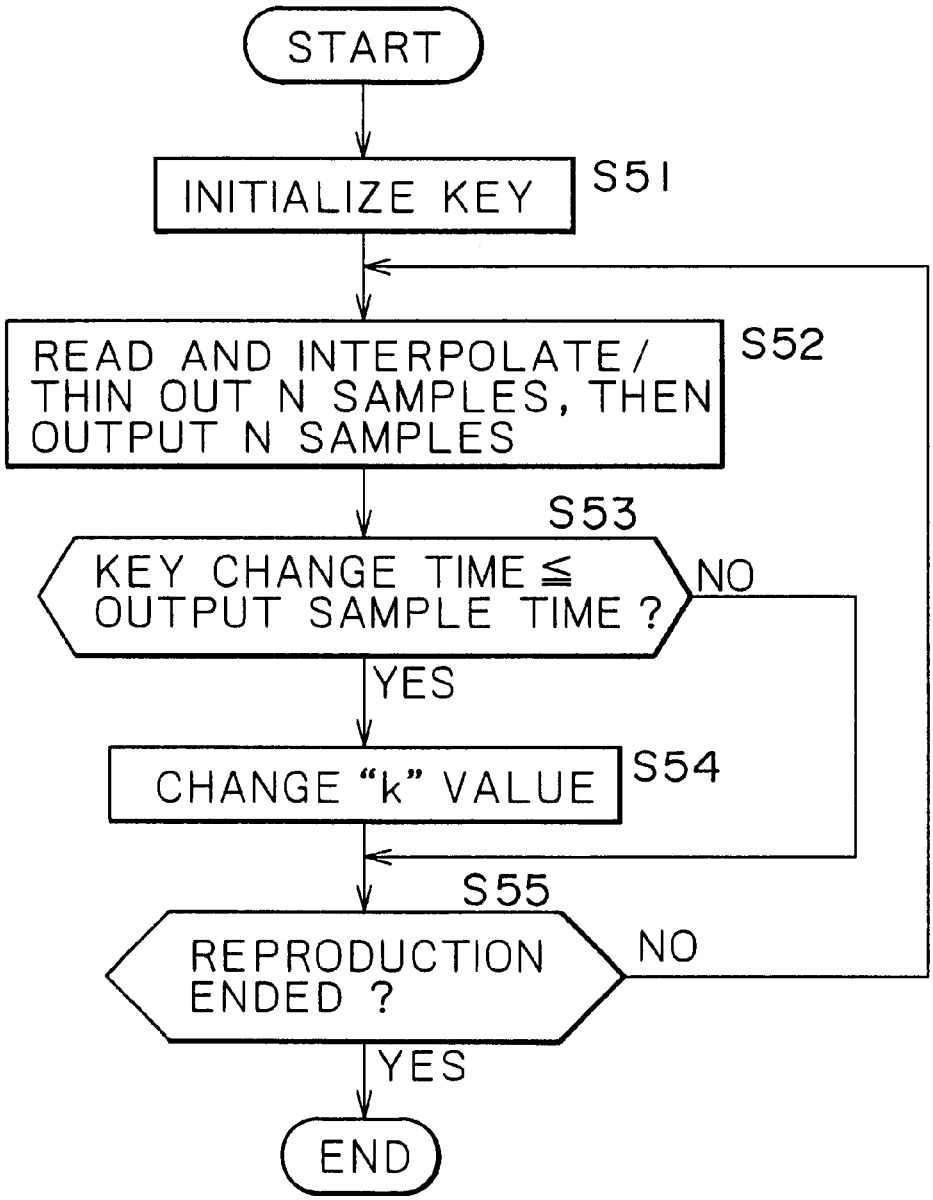
FIG. 18 is a flowchart for describing the operation of a key changer 92.

Next, the processing operation of the key changer 92 for a key change will be described with reference to the flowchart shown in FIG. 18.

At first, reproduction of audio information is instructed, the key changer 92 initializes the key and sets the parameter "k" in step S51.

Figure 19:
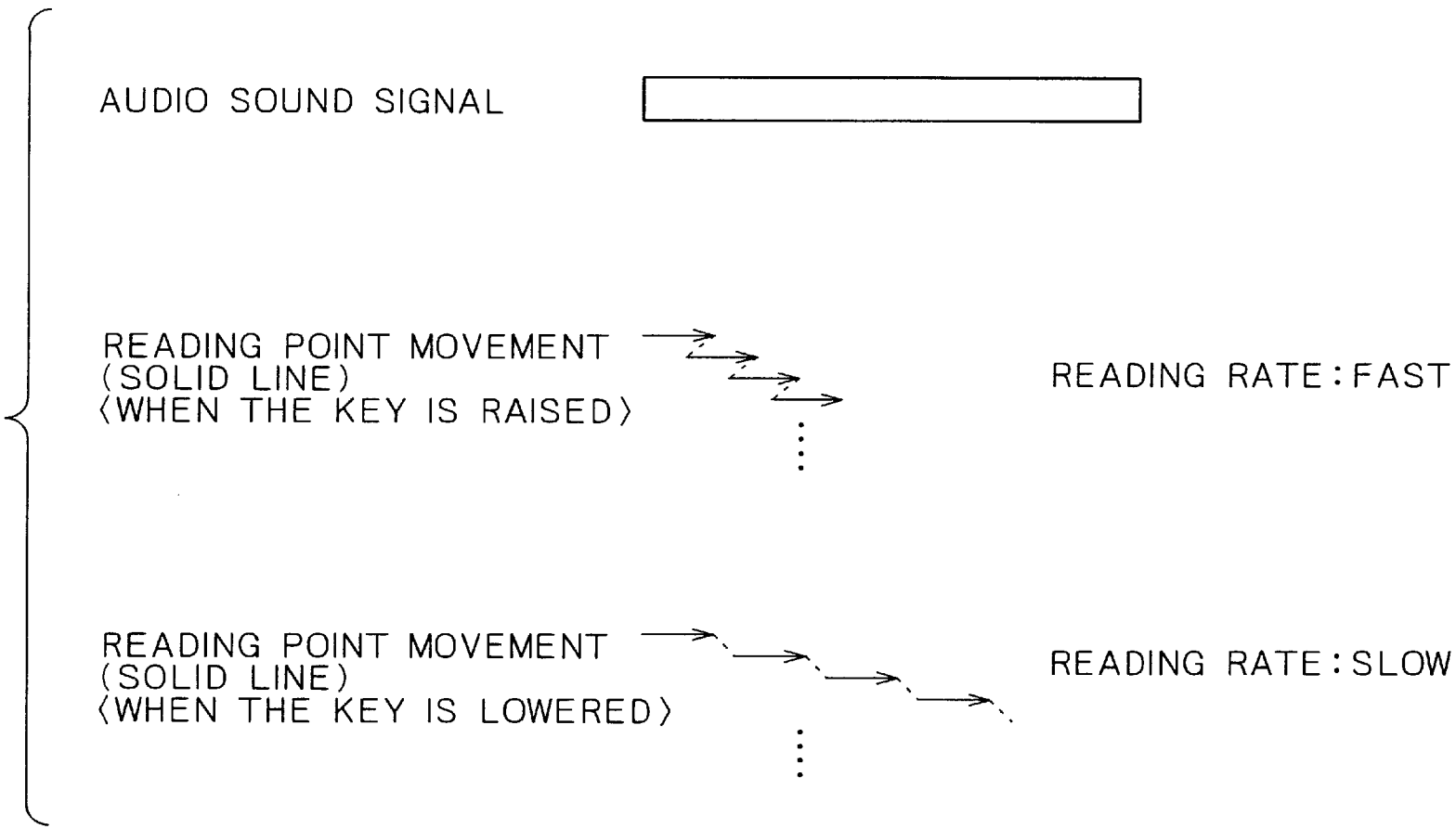
FIG. 19 is a chart for describing a key change for an audio signal.
Figure 20:
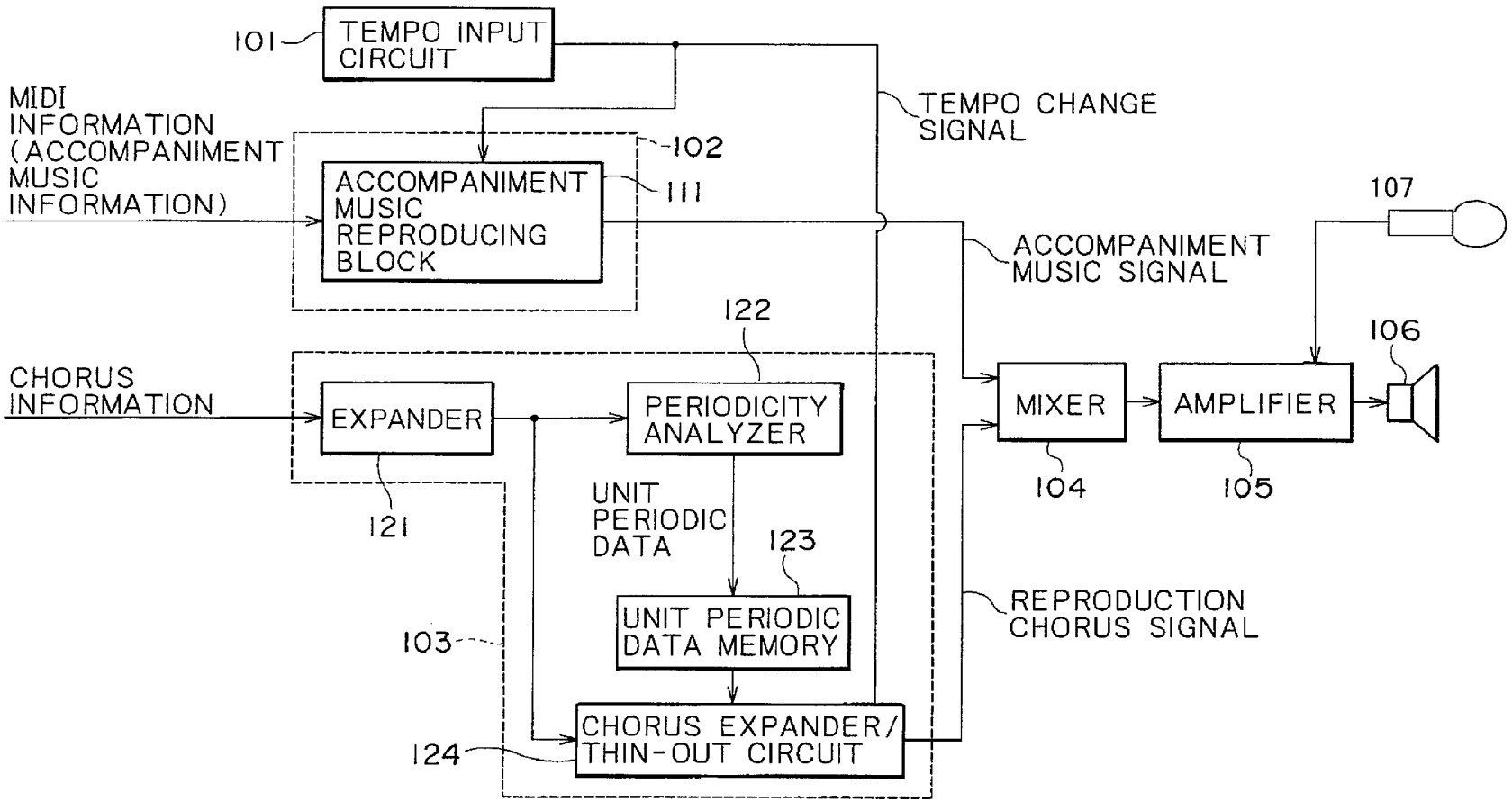
FIG. 20 is a block diagram of a conventional music reproducing apparatus.

In step S52, the key changer 92 reads N samples of audio information, then performs processes for interpolating and thinning out the data, thereby generating samples obtained by compressing or expanding original waveform information with respect to the time axis. For example, to raise a key, the reading rate of audio sound signals is increased more than the original reading rate (sampling rate), thereby some of the audio sound signals are repeated for reading them as shown in FIG. 19. To lower a key, the reading rate of audio sound signals is lowered more than the original reading rate (sampling rate), thereby the audio sound signals are read at intervals. The reproducing time of audio sound signals is fixed regardless of the key up/down. The key changer 92 changes the key for generated samples with the use of the repetitive reproducing method, thereby outputting N samples.

In step S53, the key changer 92 decides whether or not the key change time (the time set in the key change time setting block 72) supplied from the key change information memory 91 is earlier than the output sample time.

If decided in step S53 that the key change time is earlier than the output sample time, control goes to step S54, where the key changer 92 sets the parameter "k" again according to the key change information. Control then goes to step S55. If decided in step S53 that the key change time is not earlier than the output sample time, control goes to step S55. The parameter "k" is not changed at this time.

Then, in step S55, the key changer 92 decides whether or not reproduction of all the entered audio information is finished. If decided in step S55 that the reproduction is not finished yet, control goes back to step S52, where the subsequent processes are repeated again. If decided in step S55 that the reproduction is already finished, the processing is ended.

The embodiments of the present invention is not limited only to those described above; they are varied freely within the range of the concept of the present invention.

In this specification, the supply medium used for supplying a computer program that executes the above processes also includes such information recording media as magnetic disks and CD-ROMs, as well as media transmitted via such networks as the Internet, and other various digital satellites.

What is claimed is:

1. An information processing apparatus for reproducing an output audio signal from MIDI music playing information and audio information, comprising:

receiving means for receiving tempo change information indicating a tempo of output audio signal;

setting means for setting a time indicating a starting time of changing the tempo of output audio signal;

MIDI reproducing means for reproducing said MIDI audio signal from said MIDI music playing information with said tempo from said time and generating a SYNC signal;

audio reproducing means for reproducing an audio signal from audio information with said tempo from said time and outputting said reproduced audio signal synchronously with said SYNC signal; and mixing means for mixing said MIDI audio signal and said reproduced audio signal;

wherein said time is determined based on a delay time until the tempo of said MIDI audio signal is changed and a delay time until the tempo of said reproduced audio signal is changed.

2. An information processing method employed for reproducing an output audio signal from MIDI music playing information and audio information, comprising:

a receiving step for receiving tempo change information indicating a tempo of said output audio signal;

a setting step for setting a time indicating a starting time of a tempo change of said output audio signal;

a MIDI reproducing step for reproducing a MIDI audio signal from MIDI playing information with said tempo from said time and generating a SYNC signal;

an audio reproducing step for reproducing an audio signal from audio information with said tempo from said time and outputting said reproduced audio signal synchronously with said SYNC signal; and a mixing step for mixing said MIDI audio signal and said reproduced audio signal, wherein said time is determined based on a delay time until the tempo of said MIDI audio signal is changed and a delay time until the tempo of said reproduced audio signal is changed.

3. A supply medium used for supplying a program to said information processing apparatus for reproducing an output audio signal from MIDI playing information and audio information so that said program can be read by a computer that executes processes in:

a receiving step for receiving tempo chance information indicating a tempo of said output audio signal;

a setting step for setting a time indicating a starting time of a tempo change of said output audio signal;

a MIDI reproducing step for reproducing a MIDI audio signal from said MIDI playing information with said tempo from said time and generating a SYNC signal;

an audio reproducing step for reproducing an audio signal from said audio information with said tempo from said time and outputting said reproduced audio signal synchronously with said SYNC signal; and a mixing step for mixing said MIDI audio signal and said reproduced audio signal, wherein said time is determined based on a delay time until the tempo of said MIDI audio signal is changed and a delay time until the tempo of said reproduced audio signal is changed.

4. An information processing apparatus for reproducing an output audio signal from MIDI music playing information and audio information, comprising:

receiving means for receiving key change information indicating a key of output audio signal;

setting means for setting a time indicating starting time of changing the key of output audio signal;

MIDI reproducing means for reproducing MIDI audio signal from MIDI music playing information with said key from said time and generating a SYNC signal;

audio reproducing means for reproducing audio signal from audio information with said key from said time and outputting reproduced audio signal synchronously with said SYNC signal; and mixing means for mixing said MIDI audio signal and said reproduced audio signal, wherein said time is determined based on a delay time until the key of said MIDI audio signal is changed and a delay time until the key of said reproduced audio signal is changed.

5. An information processing method employed for reproducing an output audio signal from MIDI music playing information and audio information, comprising:

a receiving step for receiving key change information indicating a key of output audio signal;

a setting step for setting a time indicating starting time of changing the key of output audio signal;

a MIDI reproducing step for reproducing MIDI audio signal from MIDI music playing information with said key from said time and generating a SYNC signal;

an audio reproducing step for reproducing audio signal from audio information with said key from said time and outputting reproduced audio signal synchronously with said SYNC signal; and a mixing step for mixing said MIDI audio signal and said reproduced audio signal, wherein said time is determined based on a delay time until the key of said MIDI audio signal is changed and a delay time until the key of said reproduced audio signal is changed.

6. A supply medium used for supplying a program to said information processing apparatus for reproducing an output audio signal from MIDI playing information and audio information so that said program can be read by a computer that executes processes in:

a receiving step for receiving key change information indicating a key of said output audio signal;

a setting step for setting a time indicating starting time a change of key of said output audio signal;

a MIDI reproducing step for reproducing a MIDI audio signal from said MIDI playing information with said key from said time and generating a SYNC signal;

an audio reproducing step for reproducing an audio signal from said audio information with said key from said time and outputting said reproduced audio signal synchronously with said SYNC signal; and a mixing step for mixing said MIDI audio signal and said reproduced audio signal, wherein said time is determined based on a delay time until the key of said MIDI audio signal is changed and a delay time until the key of said reproduced audio signal is changed.

* * * * *